US009920703B2

(12) United States Patent
Katsurahara et al.

(10) Patent No.: US 9,920,703 B2
(45) Date of Patent: Mar. 20, 2018

(54) FUEL INJECTION CONTROL SYSTEM OF INTERNAL COMBUSTION ENGINE

(71) Applicant: DENSO CORPORATION, Kariya, Aichi-pref. (JP)

(72) Inventors: Hiroshi Katsurahara, Kariya (JP); Nobuyuki Satake, Kariya (JP)

(73) Assignee: DENSO CORPORATION, Kariya (JP)

( * ) Notice: Subject to any disclaimer, the term of this patent is extended or adjusted under 35 U.S.C. 154(b) by 163 days.

(21) Appl. No.: 15/027,335

(22) PCT Filed: Oct. 7, 2014

(86) PCT No.: PCT/JP2014/005096

§ 371 (c)(1),
(2) Date: Apr. 5, 2016

(87) PCT Pub. No.: WO2015/052915

PCT Pub. Date: Apr. 16, 2015

(65) Prior Publication Data

US 2016/0245211 A1 Aug. 25, 2016

(30) Foreign Application Priority Data

Oct. 11, 2013 (JP) ..... 2013-214125
Sep. 12, 2014 (JP) ..... 2014-187119

(51) Int. Cl.
*F02D 41/00* (2006.01)
*F02D 41/24* (2006.01)
(Continued)

(52) U.S. Cl.
CPC ..... *F02D 41/2467* (2013.01); *F02D 41/1402* (2013.01); *F02D 41/20* (2013.01);
(Continued)

(58) Field of Classification Search
CPC ..... F02D 41/247; F02D 41/1402; F02D 41/2467; F02D 41/20; F02D 2041/2055; F02D 2041/2051; F02D 2200/0616
See application file for complete search history.

(56) References Cited

U.S. PATENT DOCUMENTS 4,438,496 A * 3/1984 Ohie ..... F02D 41/14 123/458
5,878,722 A * 3/1999 Gras ..... F02D 41/20 123/506

(Continued)

FOREIGN PATENT DOCUMENTS

JP 2010-73705 4/2010
JP 2010-532448 10/2010

OTHER PUBLICATIONS

Katsurahara, U.S. Appl. No. 15/027,330, filed Apr. 5, 2016.
Katsurahara et al., U.S. Appl. No. 15/027,334, filed Apr. 5, 2016.

*Primary Examiner* — David Hamaoui
*Assistant Examiner* — Sherman Manley
(74) *Attorney, Agent, or Firm* — Nixon & Vanderhye P.C.

(57) ABSTRACT

At least after off of an injection pulse of partial lift injection, a first filtered voltage Vsm1 being a negative terminal voltage Vm of a fuel injection valve filtered by a first low-pass filter having a first frequency f1 as a cutoff frequency, the first frequency f1 being lower than a frequency of a noise component, is acquired, and a second filtered voltage Vsm2 being the negative terminal voltage Vm filtered by a second low-pass filter having a second frequency f2 as a cutoff frequency, the second frequency f2 being lower than the first frequency f1, is acquired. Time from a predetermined reference timing to a timing when a difference Vdiff (=Vsm1−Vsm2) between the filtered voltages has an inflection point is calculated as voltage inflection time Tdiff, and the injection pulse of the partial lift injection is corrected based on the voltage inflection time Tdiff.

20 Claims, 22 Drawing Sheets

(51) Int. Cl.
*F02D 41/20* (2006.01)
*F02D 41/14* (2006.01)

(52) U.S. Cl.
CPC ..... *F02D 2041/1432* (2013.01); *F02D 2041/2055* (2013.01)

(56) References Cited

U.S. PATENT DOCUMENTS

| | | | | |
|---|---|---|---|---|
| 6,192,855 | B1 * | 2/2001 | Schietecatte | F02D 41/1497 123/299 |
| 6,213,099 | B1 * | 4/2001 | Calvas | F02D 41/20 123/490 |
| 7,522,987 | B2 * | 4/2009 | Fujii | F02D 41/1497 123/486 |
| 2003/0071613 | A1 | 4/2003 | Schultz et al. | |
| 2008/0009999 | A1 * | 1/2008 | Sugiyama | F02D 41/2438 701/103 |
| 2016/0076498 | A1 * | 3/2016 | Aono | F02D 41/20 123/490 |
| 2016/0245211 | A1 * | 8/2016 | Katsurahara | F02D 41/20 |
| 2016/0252035 | A1 * | 9/2016 | Katsurahara | F02D 41/20 123/478 |
| 2016/0252037 | A1 * | 9/2016 | Katsurahara | F02D 41/20 123/480 |
| 2016/0281629 | A1 * | 9/2016 | Moriya | F02D 41/2467 |
| 2016/0363075 | A1 * | 12/2016 | Larocca | F02D 41/1456 |

* cited by examiner (a) VARIATION IN FALLING TIMING (b) VARIATION IN RESPONSE SPEED (c) VARIATION IN MAX VALUE

FUEL INJECTION CONTROL SYSTEM OF INTERNAL COMBUSTION ENGINE

CROSS REFERENCE TO RELATED APPLICATION

This application is the U.S. national phase of International Application No. PCT/JP2014/005096 filed on Oct. 7, 2014 which designated the U.S. and claims priority to Japanese Patent Applications No. 2013-214125 filed on Oct. 11, 2013, and No. 2014-187119 filed on Sep. 12, 2014, the entire contents of each of which are incorporated herein by reference.

TECHNICAL FIELD

The present disclosure relates to a fuel injection control system of an internal combustion engine having an electromagnetic driving fuel injection valve.

BACKGROUND ART

Generally, a fuel injection control system of an internal combustion engine includes an electromagnetic driving fuel injection valve, and calculates a required injection quantity in correspondence to an operation state of the internal combustion engine, and drives the fuel injection valve to open with an injection pulse having a width corresponding to the required injection quantity so that fuel corresponding to the required injection quantity is injected.

For a fuel injection valve of an in-cylinder injection type internal combustion engine injecting high-pressure fuel into a cylinder, however, as illustrated in FIG. 5, linearity of a variation characteristic of an actual injection quantity relative to an injection pulse width tends to be reduced in a partial lift region (a region of a partial lift state, or a region of a short injection pulse width allowing a lift amount of a valve element not to reach a full lift position). In the partial lift region, the lift amount of the valve element (for example, a needle valve) tends to greatly vary, leading to a large variation in injection quantity. Such a large variation in injection quantity may degrade exhaust emission or drivability.

An existing technique on correction of a variation in injection quantity of the fuel injection valve includes, for example, a technique described in Patent Literature 1, in which a drive voltage UM of a solenoid is compared to a reference voltage UR being the drive voltage UM filtered by a low-pass filter, and an armature position of the solenoid is detected based on an intersection of the two voltages.

In the technique of Patent Literature 1, however, the unfiltered drive voltage UM (raw value) is compared to the filtered reference voltage UR: hence, the intersection of the two voltages may not be accurately detected due to influence of noise superimposed on the unfiltered drive voltage UM. In addition, the intersection of the drive voltage UM and the reference voltage UR may not exist depending on characteristics of the solenoid. It is therefore difficult to accurately detect the armature position of the solenoid. Hence, the technique of Patent Literature 1 cannot accurately correct the variation in the injection quantity of the fuel injection valve due to the variation in the lift amount in the partial lift region.

PRIOR ART LITERATURES

Patent Literature

[Patent Literature 1] US-2003/0071613 A1

SUMMARY OF INVENTION

It is an object of the present disclosure to provide a fuel injection control system of an internal combustion engine, which accurately corrects the variation in injection quantity of the fuel injection valve due to the variation in lift amount in the partial lift region, leading to improvement in control accuracy of the injection quantity in the partial lift region.

According to an embodiment of the present disclosure, there is provided a fuel injection control system of an internal combustion engine having an electromagnetic driving fuel injection valve, the fuel injection control system including: an injection control means that performs partial lift injection to drive a fuel injection valve to open with an injection pulse allowing a lift amount of a valve element of the fuel injection valve not to reach a full lift position; a filtered-voltage acquisition means that, after off of an injection pulse of the partial lift injection, acquires a first filtered voltage being a terminal voltage of the fuel injection valve filtered by a first low-pass filter having a first frequency as a cutoff frequency, the first frequency being lower than a frequency of a noise component, and acquires a second filtered voltage being the terminal voltage filtered by a second low-pass filter having a second frequency as a cutoff frequency, the second frequency being lower than the first frequency; a difference calculation means that calculates a difference between the first filtered voltage and the second filtered voltage; a time calculation means that calculates time from a predetermined reference timing to a timing when the difference has an inflection point as voltage inflection time; a learning means that obtains an averaged value of a predetermined frequency of data of the voltage inflection time as a learning value of the voltage inflection time; and an injection pulse correction means that corrects the injection pulse of the partial lift injection based on the learning value of the voltage inflection time.

A terminal voltage (for example, a negative terminal voltage) of the fuel injection valve is varied by induced electromotive force after off of the injection pulse (see FIG. 9). At this time, when the fuel injection valve is closed, shift speed of the valve element (shift speed of a movable core) varies relatively greatly, and thus a variation characteristic of the terminal voltage is varied. This results in such a voltage inflection point that the variation characteristic of the terminal voltage is varied near valve-closing timing.

Focusing on such a characteristic, in the disclosure, after off of the injection pulse of the partial lift injection, the first filtered voltage being the terminal voltage filtered (moderated) by the first low-pass filter having the first frequency as a cutoff frequency, the first frequency being lower than a frequency of a noise component, is acquired, and the second filtered voltage being the terminal voltage filtered (moderated) by the second low-pass filter having the second frequency as a cutoff frequency, the second frequency being lower than the first frequency, is acquired. Consequently, it is possible to acquire the first filtered voltage being the terminal voltage from which a noise component is removed and the second filtered voltage for voltage inflection detection.

Furthermore, the difference between the first filtered voltage and the second filtered voltage is calculated, and the time from the predetermined reference timing to the timing when the difference has an inflection point is calculated as the voltage inflection time. Consequently, it is possible to accurately calculate the voltage inflection time that varies depending on the valve-closing timing of the fuel injection valve.

In the partial lift region of the fuel injection valve, as illustrated in FIG. 6, a variation in lift amount causes variations in injection quantity and in valve-closing timing, leading to a correlation between the injection quantity of the fuel injection valve and the valve-closing timing. Furthermore, the voltage inflection time varies depending on valve-closing timing of the fuel injection valve, leading to a correlation between the voltage inflection time and the injection quantity as illustrated in FIG. 7.

Focusing on such relationships, the injection pulse of the partial lift injection is corrected based on the voltage inflection time, thereby the injection pulse of the partial lift injection can be accurately corrected. Consequently, it is possible to accurately correct the variation in injection quantity due to the variation in lift amount in the partial lift region, leading to improvement in control accuracy of the injection quantity in the partial lift region.

BRIEF DESCRIPTION OF DRAWINGS

The above-described objects, other objects, features, and advantages of the present disclosure will be more clarified from the following detailed description with reference to the accompanying drawings.

EMBODIMENTS FOR CARRYING OUT INVENTION

Some embodiments embodying modes for carrying out the disclosure are now described.

First Embodiment

A first embodiment of the disclosure is described with reference to FIGS. 1 to 9.

Figure 1:
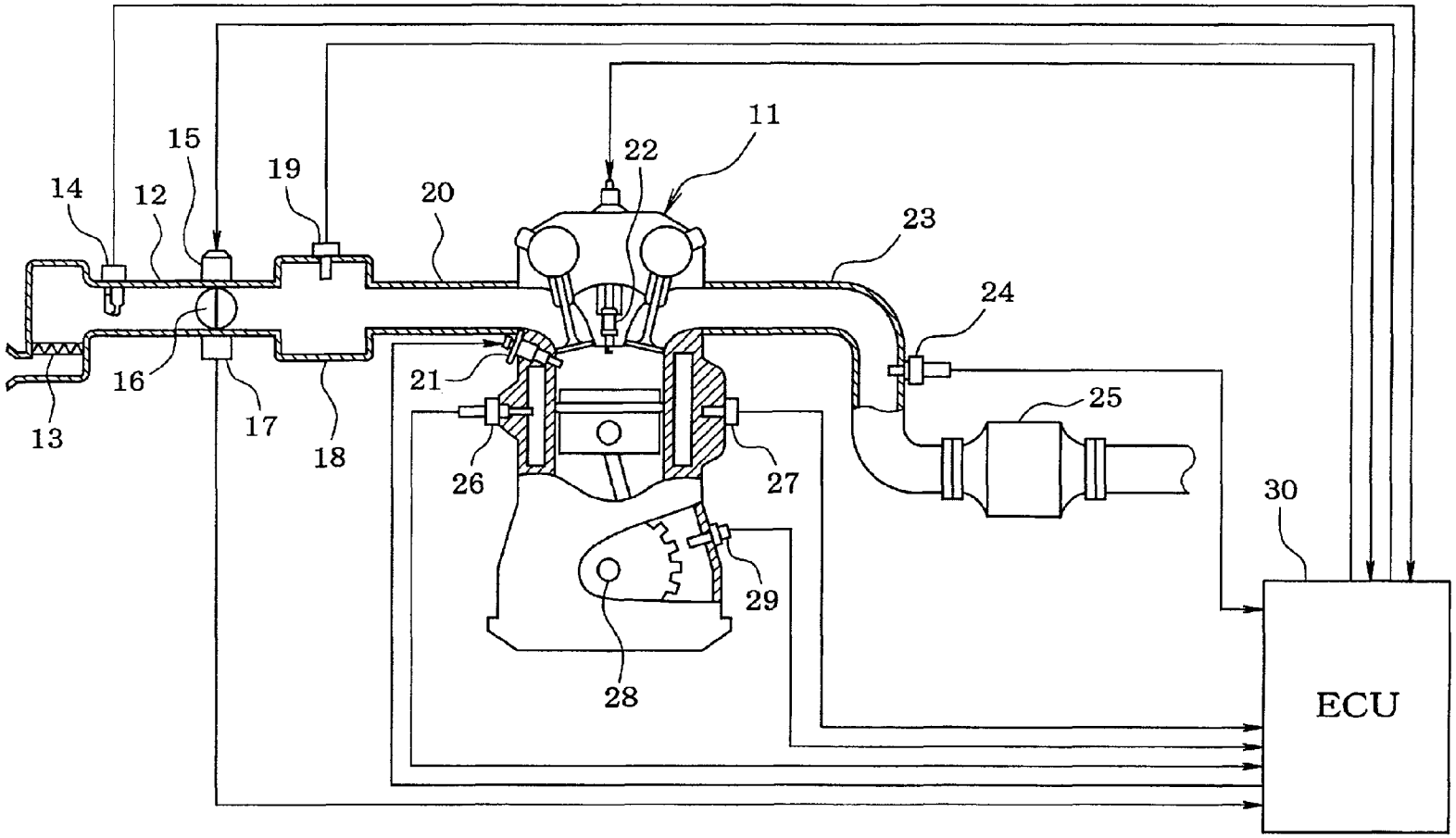
FIG. 1 is a diagram illustrating a schematic configuration of an engine control system of a first embodiment of the disclosure.

A schematic configuration of an engine control system is described with reference to FIG. 1.

An in-cylinder injection engine 11, which is an in-cylinder injection internal combustion engine, has an air cleaner 13 on a most upstream side of an intake pipe 12, and has an air flow meter 14 detecting an intake air amount on a downstream side of the air cleaner 13. A throttle valve 16, of which the degree of opening is adjusted by a motor 15, and a throttle position sensor 17, which detects the degree of opening of the throttle valve 16 (throttle position), are provided on a downstream side of the air flow meter 14.

A surge tank 18 is further provided on the downstream side of the throttle valve 16, and an intake pipe pressure sensor 19 detecting intake pipe pressure is provided in the surge tank 18. The surge tank 18 has an intake manifold 20 introducing air into each cylinder of the engine 11, and the cylinder has a fuel injection valve 21 that directly injects fuel into the cylinder. An ignition plug 22 is attached to each cylinder head of the engine 11. An air-fuel mixture in each cylinder is ignited by spark discharge of the ignition plug 22 of each cylinder.

An exhaust pipe 23 of the engine 11 has an exhaust gas sensor 24 (an air-fuel ratio sensor, an oxygen sensor) that detects an air-fuel ratio, rich or lean, etc. of exhaust gas. A catalyst 25 such as a ternary catalyst purifying the exhaust gas is provided on a downstream side of the exhaust gas sensor 24.

A cooling water temperature sensor 26 detecting cooling water temperature and a knock sensor 27 detecting knocking are attached to a cylinder block of the engine 11. A crank angle sensor 29, which outputs a pulse signal every time when a crank shaft 28 rotates a predetermined crank angle, is attached on a peripheral side of the crank shaft 28, and a crank angle or engine rotation speed is detected based on an output signal of the crank angle sensor 29.

Output of each of such sensors is received by an electronic control unit (hereinafter mentioned as "ECU") 30. The ECU 30 is mainly configured of a microcomputer, and executes various engine control programs stored in an internal ROM (storage medium), and thereby controls a fuel injection quantity, ignition timing, and a throttle position (an intake air amount) depending on an engine operation state.

Figure 2:
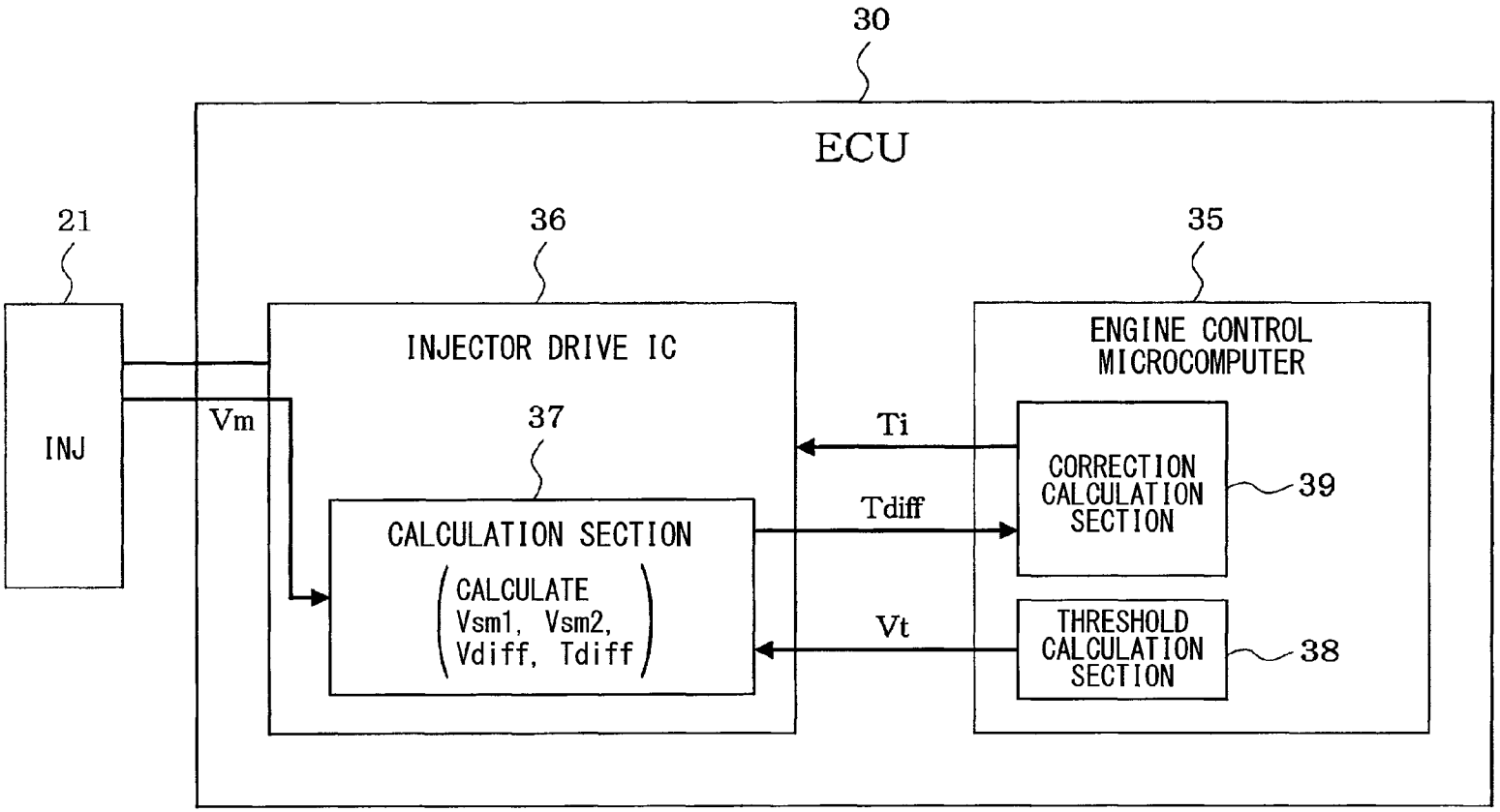
FIG. 2 is a block diagram illustrating a configuration of ECU of the first embodiment.

As illustrated in FIG. 2, the ECU 30 has an engine control microcomputer 35 (a microcomputer for control of the engine 11), and an injector drive IC 36 (a drive IC of the fuel injection valve 21), and the like. The ECU 30, specifically the engine control microcomputer 35, calculates a required injection quantity in correspondence to an operation state of the engine (for example, engine rotation speed or an engine load), and calculates a required injection pulse width Ti (injection time) in correspondence to the required injection quantity. In addition, the ECU 30, specifically the injector drive IC 36, drives the fuel injection valve 21 to open with the required injection pulse width Ti corresponding to the required injection quantity so that fuel corresponding to the required injection quantity is injected.

Figure 3:
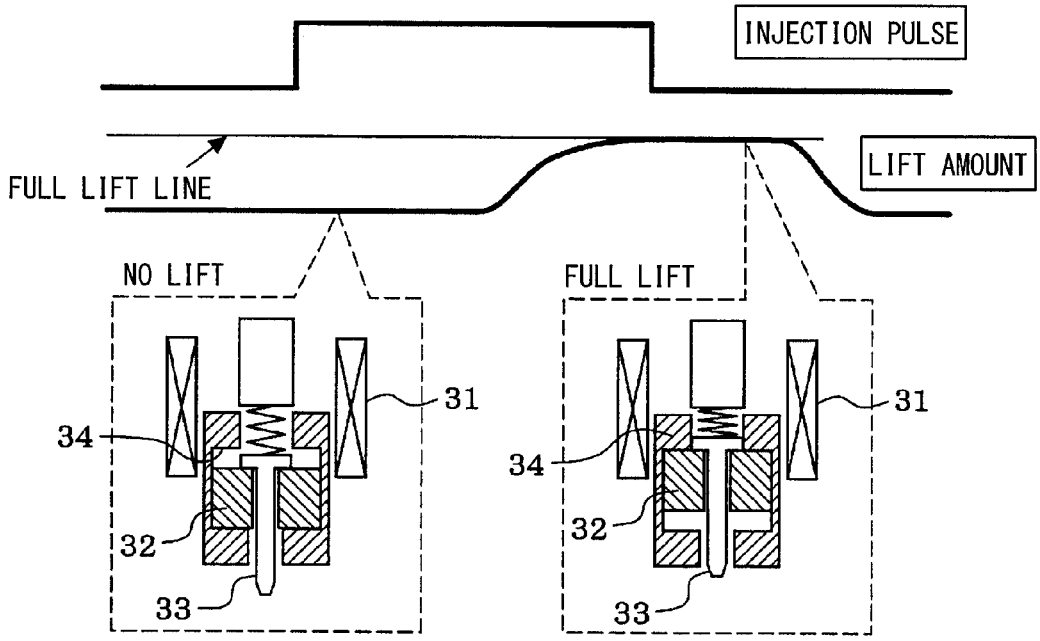
FIG. 3 is a schematic illustration of full lift of a fuel injection valve.
Figure 4:
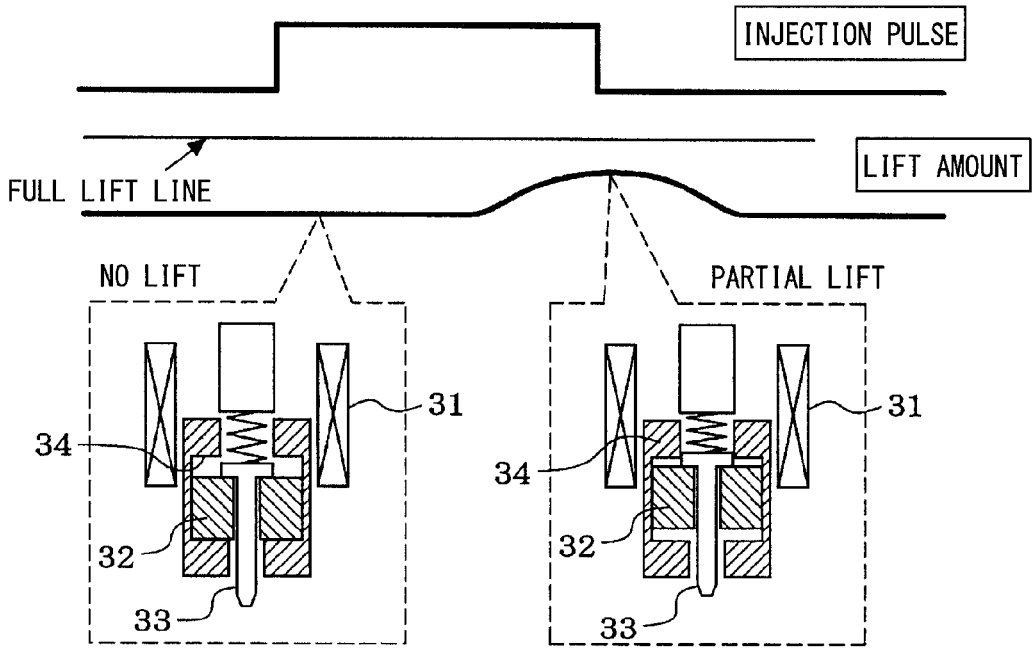
FIG. 4 is a schematic illustration of partial lift of the fuel injection valve.

As illustrated in FIGS. 3 and 4, the fuel injection valve 21 is configured such that when an injection pulse is on so that a current is applied to a drive coil 31, a needle valve 33 (valve element) is moved in a valve-opening direction together with a plunger 32 (movable core) by electromagnetic force generated by the drive coil 31. As illustrated in FIG. 3, the lift amount of the needle valve 33 reaches a full lift position (a position at which the plunger 32 butts against a stopper 34) in a full lift region where an injection pulse width is relatively long. As illustrated in FIG. 4, a partial lift state (a state just before the plunger 32 butts against the stopper 34), in which the lift amount of the needle valve 33 does not reach the full lift position, is given in a partial lift region where the injection pulse width is relatively short.

The ECU 30 serves as an injection control means that performs, in the full lift region, full lift injection to drive the fuel injection valve 21 to open with an injection pulse allowing the lift amount of the needle valve 33 to reach the full lift position, and performs, in the partial lift region, partial lift injection to drive the fuel injection valve 21 to open with an injection pulse providing the partial lift state in which the lift amount of the needle valve 33 does not reach the full lift position.

Figure 5:
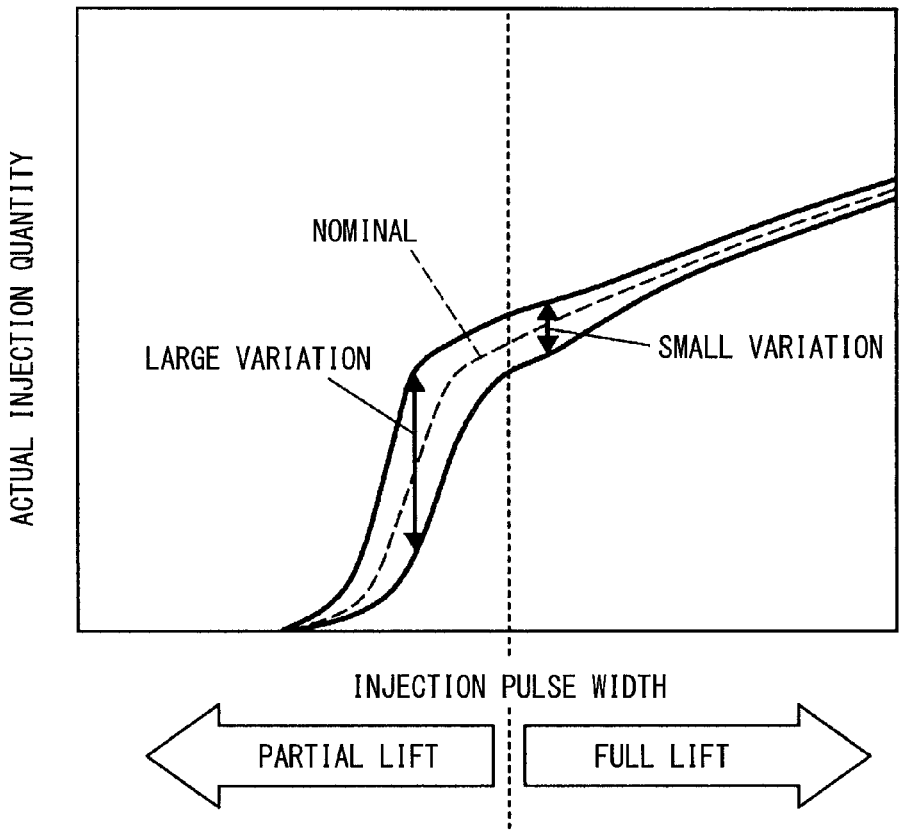
FIG. 5 is a diagram illustrating a relationship between an injection pulse width and an actual injection quantity of the fuel injection valve.

For the fuel injection valve 21 of the in-cylinder injection engine 11 that injects high-pressure fuel into the cylinder, as illustrated in FIG. 5, linearity of a variation characteristic of an actual injection quantity with respect to an injection pulse width tends to degrade in the partial lift region (a region of the partial lift state in which the injection pulse width is short so that the lift amount of the needle valve 33 does not reach the full lift position). In the partial lift region, the lift amount of the needle valve 33 tends to greatly vary, leading to a large variation in the injection quantity. Such a large variation in the injection quantity may degrade exhaust emission and drivability.

Figure 9:
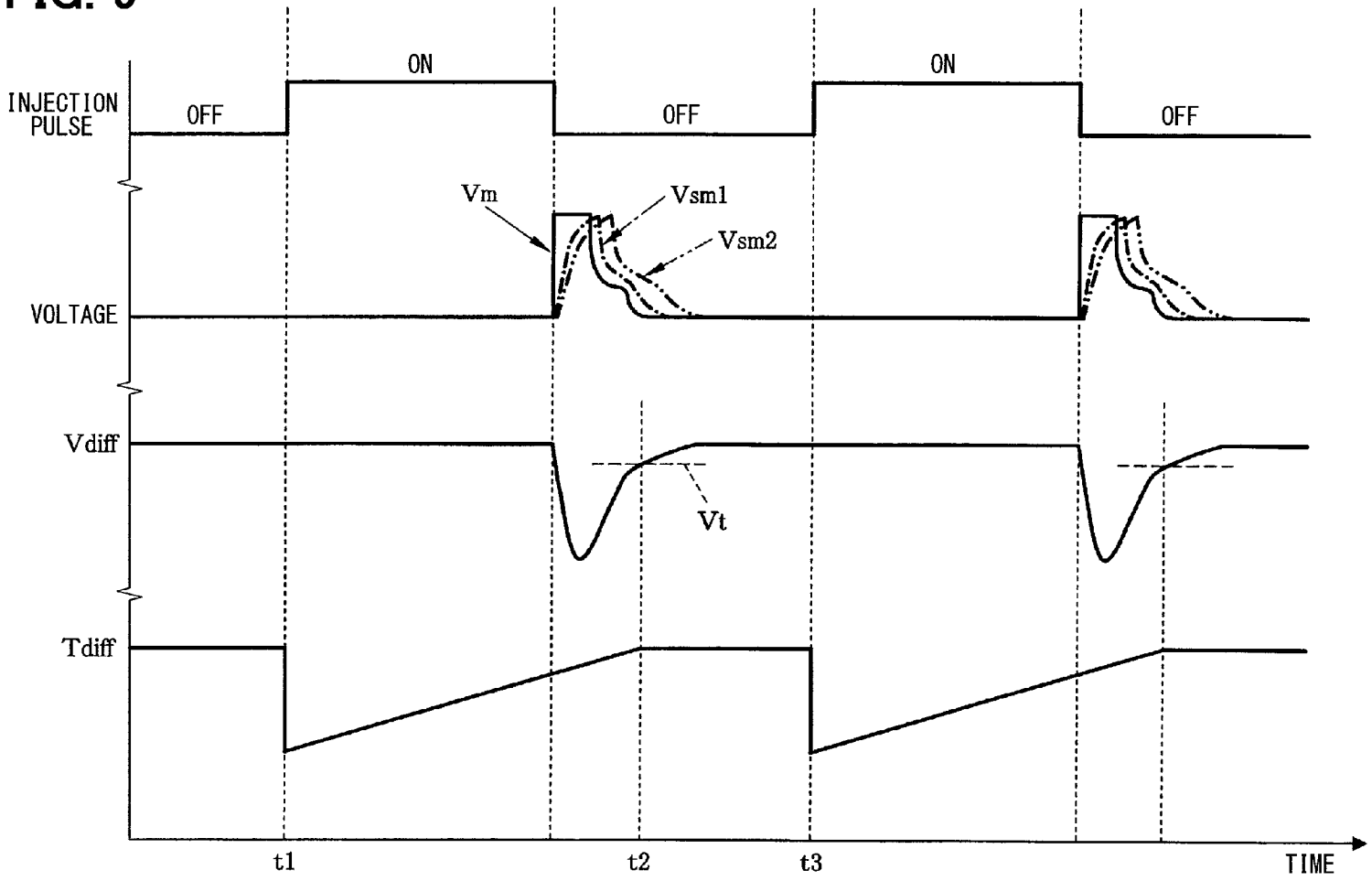
FIG. 9 is a time chart illustrating a voltage inflection time calculation in the first embodiment.

The negative terminal voltage of the fuel injection valve 21 is varied by induced electromotive force after off of the injection pulse (see FIG. 9). At this time, when the fuel injection valve 21 is closed, shift speed of the needle valve 33 (shift speed of the plunger 32) varies relatively greatly, and thus a variation characteristic of the negative terminal voltage is varied. This results in such a voltage inflection point that the variation characteristic of the negative terminal voltage is varied near the valve-closing timing.

Focusing on such a characteristic, in the first embodiment, the ECU 30 (for example, the injector drive IC 36) executes a voltage inflection time calculation routine of FIG. 8 described later, thereby the voltage inflection time as information on the valve-closing timing is calculated as follows.

During the partial lift injection (at least after off of an injection pulse of the partial lift injection), the ECU 30, specifically a calculation section 37 of the injector drive IC 36, performs a process for each of the cylinders of the engine 11. In the process, the ECU 30 calculates a first filtered voltage Vsm1 being a negative terminal voltage Vm of the fuel injection valve 21 filtered (moderated) by a first low-pass filter having a first frequency f1 as a cutoff frequency, the first frequency f1 being lower than a frequency of a noise component, and calculates a second filtered voltage Vsm2 being the negative terminal voltage Vm of the fuel injection valve 21 filtered (moderated) by a second low-pass filter having a second frequency f2 as a cutoff frequency, the second frequency f2 being lower than the first frequency. Consequently, it is possible to calculate the first filtered voltage Vsm1 being the negative terminal voltage Vm from which a noise component is removed, and the second filtered voltage Vsm2 for voltage inflection detection.

Furthermore, the ECU 30, specifically the calculation section 37 of the injector drive IC 36, performs a process for each of the cylinders of the engine 11. In the process, the ECU 30 calculates a difference Vdiff (=Vsm1−Vsm2) between the first filtered voltage Vsm1 and the second filtered voltage Vsm2, and calculates time from a predetermined reference timing to a timing when the difference Vdiff has a inflection point as voltage inflection time Tdiff. At this time, in the first embodiment, the ECU 30 calculates the voltage inflection time Tdiff with a timing when the difference Vdiff exceeds a predetermined threshold Vt as the timing when the difference Vdiff has an inflection point. In other words, time from the predetermined reference timing to the timing when the difference Vdiff exceeds the predetermined threshold Vt is calculated as the voltage inflection time Tdiff. Consequently, it is possible to accurately calculate the voltage inflection time Tdiff that varies depending on the valve-closing timing of the fuel injection valve 21. In the first embodiment, the voltage inflection time Tdiff is calculated with the reference timing being a timing when an injection pulse of the partial lift injection is switched from off to on. The threshold Vt is calculated by a threshold calculation section 38 of the engine control microcomputer 35 depending on fuel pressure, fuel temperature, or the like. The threshold Vt may be a beforehand set, fixed value.

Figure 6:
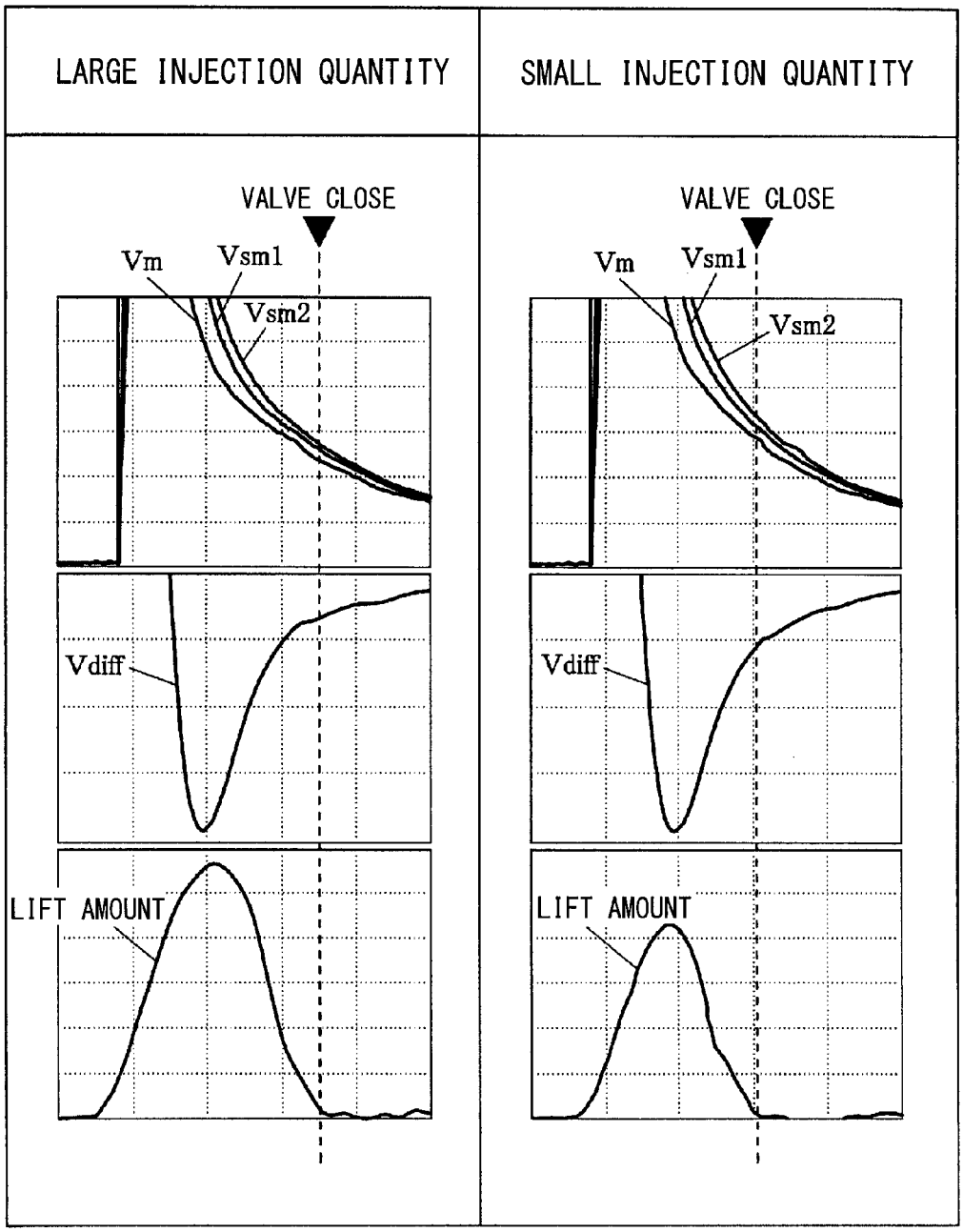
FIG. 6 is a schematic illustration of a relationship between an injection quantity and valve-closing timing of the fuel injection valve.
Figure 7:
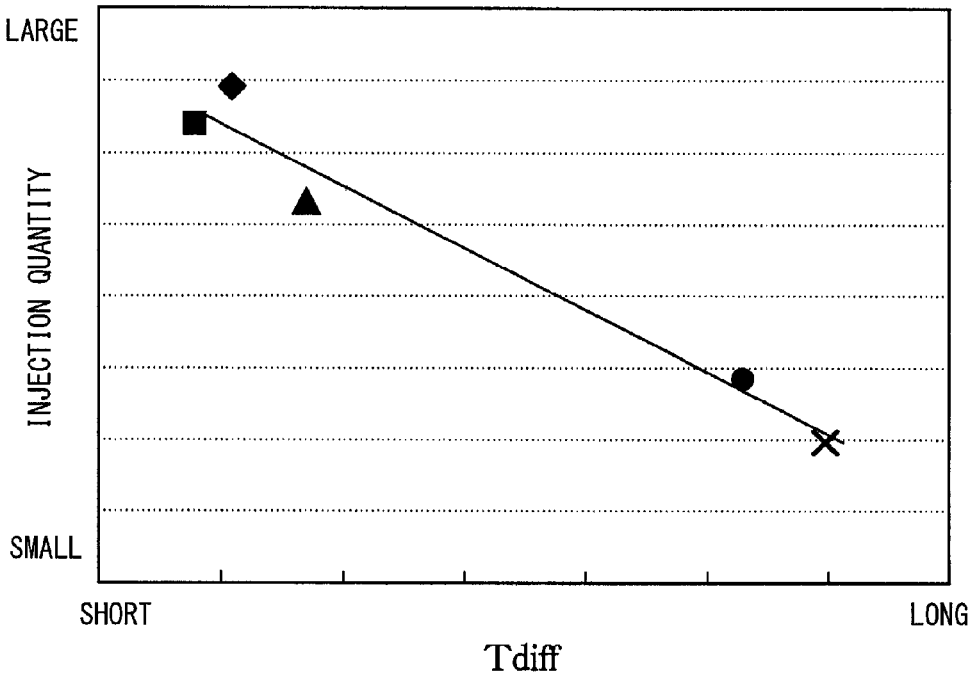
FIG. 7 is a diagram illustrating a relationship between voltage inflection time and the injection quantity of the fuel injection valve.

In the partial lift region of the fuel injection valve 21, as illustrated in FIG. 6, since a variation in lift amount of the fuel injection valve 21 causes variations in the injection quantity and in the valve-closing timing, a correlation exists between the injection quantity and the valve-closing timing of the fuel injection valve 21. Furthermore, since the voltage inflection time Tdiff varies depending on the valve-closing timing of the fuel injection valve 21, a correlation exists between the voltage inflection time Tdiff and the injection quantity as illustrated in FIG. 7.

Focusing on such relationships, the ECU 30 (for example, the engine control microcomputer 35) executes an injection pulse correction routine. The ECU 30 thereby corrects the injection pulse of the partial lift injection based on the voltage inflection time Tdiff.

In the first embodiment, the injector drive IC 36 (the calculation section 37) collectively serves as the filtered-voltage acquisition means, the difference calculation means, and the time calculation means. The engine control microcomputer 35 (an injection pulse correction calculation section 39) serves as the injection pulse correction means.

Figure 8:
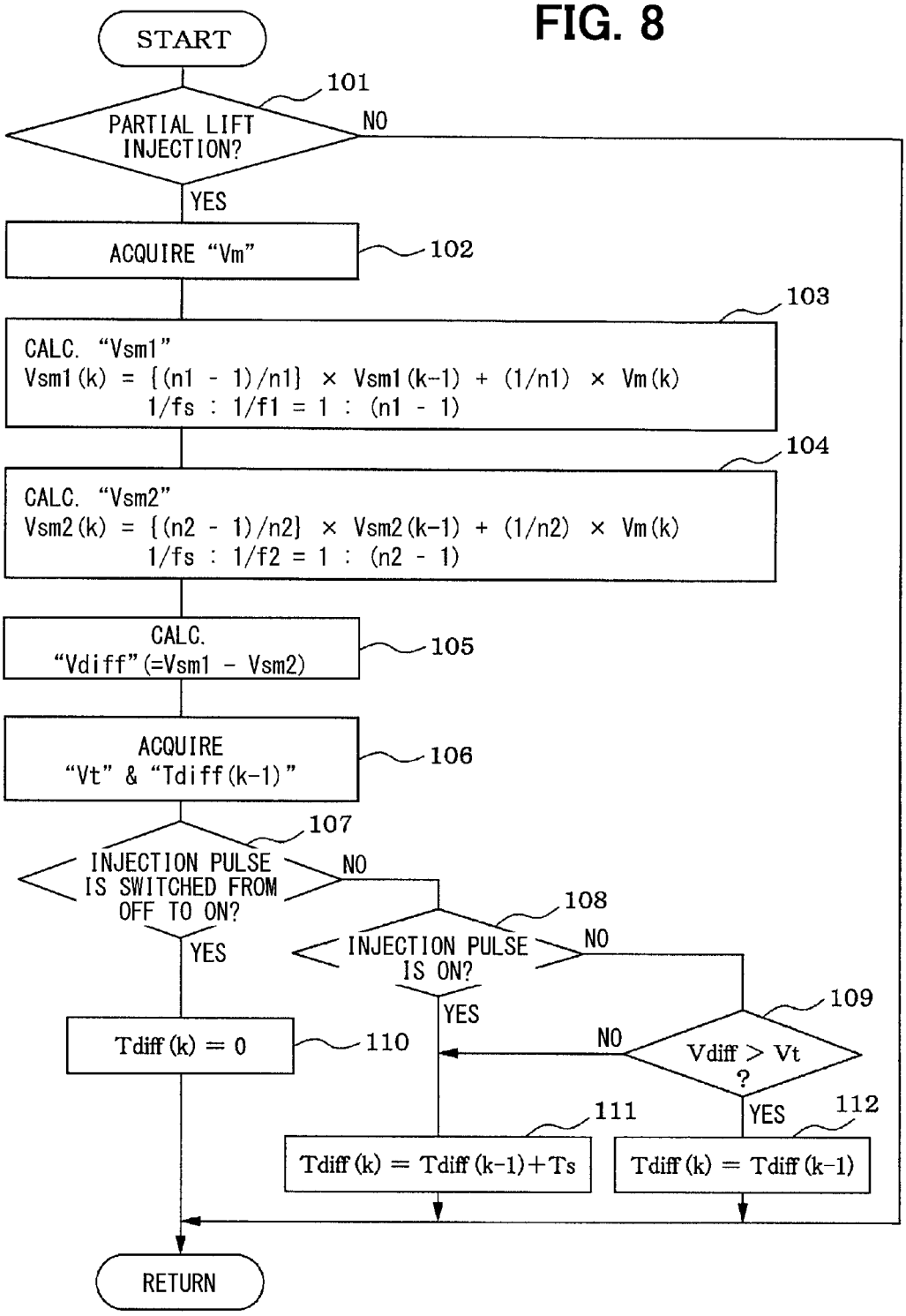
FIG. 8 is a flowchart illustrating a procedure of a voltage inflection time calculation routine in the first embodiment.

Processing details of routines, i.e., the voltage inflection time calculation routine of FIG. 8 executed by the ECU 30 (the engine control microcomputer 35 and/or the injector drive IC 36) in the first embodiment are now described.

The voltage inflection time calculation routine illustrated in FIG. 8 is repeatedly executed with a predetermined calculation period Ts during power-on of the ECU 30 (for example, during on of an ignition switch). When this routine is started, whether or not the partial lift injection is being performed is determined in step 101. If the partial lift injection is determined to be not being performed in step 101, the routine is finished while step 102 and subsequent steps are not performed.

If the partial lift injection is determined to be being performed in step 101, then in step 102 the negative terminal voltage Vm of the fuel injection valve 21 is acquired. In this case, the calculation period Ts of the routine corresponds to a sampling period Ts of the negative terminal voltage Vm.

Subsequently, in step 103, there is calculated a first filtered voltage Vsm1 being the negative terminal voltage Vm of the fuel injection valve 21 filtered by a first low-pass filter having a first frequency f1 as a cutoff frequency, the first frequency f1 being lower than a frequency of a noise component, (i.e., a low-pass filter having a passband being a frequency band lower than the cutoff frequency f1).

The first low-pass filter is a digital filter implemented by Formula (1) to obtain a current value Vsm1(k) of the first filtered voltage using a previous value Vsm1(k−1) of the first filtered voltage and a current value Vm(k) of the negative terminal voltage.

$$Vsm1(k)=\{(n1-1)/n1\}\times Vsm1(k-1)+(1/n1)\times Vm(k) \quad (1)$$

The time constant n1 of the first low-pass filter is set such that the relationship of Formula (2) is satisfied, where fs (=1/Ts) is a sampling frequency of the negative terminal voltage Vm, and f1 is the cutoff frequency of the first low-pass filter.

$$1/fs:1/f1=1:(n1-1) \quad (2)$$

Consequently, it is possible to easily calculate the first filtered voltage Vsm1 filtered by the first low-pass filter having the first frequency f1 as the cutoff frequency, the first frequency f1 being lower than the frequency of the noise component.

Subsequently, in step 104, there is calculated a second filtered voltage Vsm2 being the negative terminal voltage Vm of the fuel injection valve 21 filtered by a second low-pass filter having a second frequency f2 as a cutoff frequency, the second frequency f2 being lower than the first frequency f1 (i.e., a low-pass filter having a passband being a frequency band lower than the cutoff frequency f2).

The second low-pass filter is a digital filter implemented by Formula (3) to obtain a current value Vsm2(k) of the second filtered voltage using a previous value Vsm2(k−1) of the second filtered voltage and a current value Vm(k) of the negative terminal voltage.

$$Vsm2(k)=\{(n2-1)/n2\}\times Vsm2(k-1)+(1/n2)\times Vm(k) \quad (3)$$

The time constant n2 of the second low-pass filter is set such that the relationship of Formula (4) is satisfied, where fs (=1/Ts) is the sampling frequency of the negative terminal voltage Vm, and f2 is the cutoff frequency of the second low-pass filter.

$$1/fs:1/f2=1:(n2-1) \quad (4)$$

Consequently, it is possible to easily calculate the second filtered voltage Vsm2 filtered by the second low-pass filter having the second frequency f2 as the cutoff frequency, the second frequency f2 being lower than the first frequency f1.

Subsequently, in step 105, the difference Vdiff (=Vsm1−Vsm2) between the first filtered voltage Vsm1 and the second filtered voltage Vsm2 is calculated. The difference Vdiff may be subjected to guard processing so as to be less than 0 to extract only a negative component.

Subsequently, in step 106, the threshold Vt is acquired, and a previous value Tdiff(k−1) of the voltage inflection time is acquired.

Subsequently, in step 107, whether or not the injection pulse is switched from off to on at the current timing is determined. If the injection pulse is determined to be switched from off to on at the current timing in step 107, then in step 110 a current value Tdiff(k) of the voltage inflection time is reset to "0".

$$Tdiff(k)=0$$

If the injection pulse is determined to be not switched from off to on at the current timing in step 107, then in step 108 whether or not the injection pulse is on is determined. If the injection pulse is determined to be on in step 108, then in step 111 a predetermined value Ts (the calculation period of this routine) is added to the previous value Tdiff(k−1) of the voltage inflection time to obtain the current value Tdiff(k) of the voltage inflection time, so that the voltage inflection time Tdiff is counted up.

$$Tdiff(k)=Tdiff(k-1)+Ts$$

If the injection pulse is determined to be not on (i.e., the injection pulse is off) in step 108, then in step 109 whether or not the difference Vdiff between the first filtered voltage Vsm1 and the second filtered voltage Vsm2 exceeds the threshold Vt (whether or not the difference Vdiff inversely becomes larger than the threshold Vt) is determined.

If the difference Vdiff between the first filtered voltage Vsm1 and the second filtered voltage Vsm2 is determined not to exceed the threshold Vt in step 109, the voltage inflection time Tdiff is continuously counted up in step 111.

If the difference Vdiff between the first filtered voltage Vsm1 and the second filtered voltage Vsm2 is determined to exceed the threshold Vt in step 109, then in step 112 calculation of the voltage inflection time Tdiff is determined to be completed, and the current value Tdiff(k) of the voltage inflection time is maintained to the previous value Tdiff(k−1).

$$Tdiff(k)=Tdiff(k-1)$$

Consequently, time from a timing (reference timing), at which the injection pulse is switched from off to on, to a timing, at which the difference Vdiff exceeds the threshold Vt, is calculated as the voltage inflection time Tdiff, and the calculated value of the voltage inflection time Tdiff is maintained until the next reference timing. The process of calculating the voltage inflection time Tdiff is thus performed for each of the cylinders of the engine 11.

Referring to a time chart showing in FIG. 9, a voltage inflection time calculation will be explained.

During the partial lift injection (at least after off of the injection pulse of the partial lift injection), the first filtered voltage Vsm1 being the negative terminal voltage Vm of the fuel injection valve 21 filtered by the first low-pass filter is calculated, and the second filtered voltage Vsm2 being the negative terminal voltage Vm of the fuel injection valve 21 filtered by the second low-pass filter is calculated. Furthermore, the difference Vdiff (=Vsm1−Vsm2) between the first filtered voltage Vsm1 and the second filtered voltage Vsm2 is calculated.

The voltage inflection time Tdiff is reset to "0" at a timing (reference timing) t1 when the injection pulse is switched from off to on, and then calculation of the voltage inflection time Tdiff is started, and the voltage inflection time Tdiff is repeatedly counted up with the predetermined calculation period Ts.

Subsequently, the calculation of the voltage inflection time Tdiff is completed at a timing t2 when the difference Vdiff between the first filtered voltage Vsm1 and the second filtered voltage Vsm2 exceeds the threshold Vt after off of the injection pulse. Consequently, time from the timing (reference timing) t1, at which the injection pulse is switched from off to on, to the timing t2, at which the difference Vdiff exceeds the threshold Vt, is calculated as the voltage inflection time Tdiff.

The calculated value of the voltage inflection time Tdiff is maintained until the next reference timing t3, during which (during a period from the calculation completion timing t2 of the voltage inflection time Tdiff to the next reference timing t3) the engine control microcomputer 35 acquires the voltage inflection time Tdiff from the injector drive IC 36.

In the first embodiment, during the partial lift injection (at least after off of the injection pulse of the partial lift injection), the first filtered voltage Vsm1 being the negative terminal voltage Vm of the fuel injection valve 21 filtered by the first low-pass filter is calculated, making it possible to calculate the first filtered voltage Vsm1 containing no noise component. In addition, the second filtered voltage Vsm2 being the negative terminal voltage Vm of the fuel injection valve 21 filtered with the second low-pass filter is calculated, making it possible to calculate the second filtered voltage Vsm2 for voltage inflection detection.

Furthermore, the difference Vdiff between the first filtered voltage Vsm1 and the second filtered voltage Vsm2 is calculated, and the time from the timing (reference timing), at which the injection pulse is switched from off to on, to the timing, at which the difference Vdiff exceeds the threshold Vt, is calculated as the voltage inflection time Tdiff, making it possible to accurately calculate the voltage inflection time Tdiff that varies depending on the valve-closing timing of the fuel injection valve 21.

The injection pulse of the partial lift injection is corrected based on the voltage inflection time Tdiff, thereby the injection pulse of the partial lift injection can be accurately corrected.

In the first embodiment, since a digital filter is used as each of the first and second low-pass filters, the first and second low-pass filters can be easily implemented.

Furthermore, in the first embodiment, the injector drive IC 36 (the calculation section 37) collectively serves as the filtered-voltage acquisition means, the difference calculation means, and the time calculation means. Hence, the functions of the filtered-voltage acquisition means, the difference calculation means, and the time calculation means can be achieved only by modifying the specification of the injector drive IC 36 in the ECU 30, and the calculation load of the engine control microcomputer 35 can be reduced.

In the first embodiment, the voltage inflection time Tdiff is calculated with the reference timing being a timing when the injection pulse is switched from off to on; hence, the voltage inflection time Tdiff can be accurately calculated with reference to the timing when the injection pulse is switched from off to on.

In the first embodiment, the voltage inflection time Tdiff is reset at the reference timing, and then calculation of the voltage inflection time Tdiff is started, and calculation of the voltage inflection time Tdiff is completed at the timing when the difference Vdiff between the first filtered voltage Vsm1 and the second filtered voltage Vsm2 exceeds the threshold Vt. Hence, the calculated value of the voltage inflection time Tdiff can be maintained from completion of calculation of the voltage inflection time Tdiff to the next reference timing, which lengthens a period during which the engine control microcomputer 35 can acquire the voltage inflection time Tdiff.

Second Embodiment

A second embodiment of the disclosure is now described with reference to FIGS. 10 and 11. However, portions substantially the same as those in the first embodiment are not or briefly described, and differences from the first embodiment are mainly described.

In the first embodiment, the voltage inflection time Tdiff is calculated with the timing, at which the difference Vdiff between the first filtered voltage Vsm1 and the second filtered voltage Vsm2 exceeds the threshold Vt, as the timing when the difference Vdiff has an inflection point. In the second embodiment, the ECU 30 executes a voltage inflection time calculation routine of FIG. 10 described later so that the voltage inflection time Tdiff is calculated as follows.

The ECU 30, specifically the calculation section 37 of the injector drive IC 36, calculates a third filtered voltage Vdiff.sm3 being the difference Vdiff filtered (moderated) by a third low-pass filter having a third frequency f3 as the cutoff frequency, the third frequency f3 being lower than a frequency of a noise component, and calculates a fourth filtered voltage Vdiff.sm4 being the difference Vdiff filtered (moderated) by a fourth low-pass filter having a fourth frequency f4 as the cutoff frequency, the fourth frequency f4 being lower than the third frequency f3. Furthermore, a difference between the third filtered voltage Vdiff.sm3 and the fourth filtered voltage Vdiff.sm4 is calculated as a second order differential Vdiff2 (=Vdiff.sm3−Vdiff.sm4), and the voltage inflection time Tdiff is calculated with a timing when the second order differential Vdiff2 has an extreme value (for example, a timing when the second order differential Vdiff2 no longer increases) as the timing when the difference Vdiff has an inflection point. Specifically, time from a predetermined reference timing to the timing when the second order differential Vdiff2 has an extreme value is calculated as the voltage inflection time Tdiff. This makes it possible to accurately calculate the voltage inflection time Tdiff, which varies depending on valve-closing timing of the fuel injection valve 21, at an early timing. In the second embodiment, the voltage inflection time Tdiff is calculated with a reference timing being a timing when the injection pulse of the partial lift injection is switched from off to on.

Figure 10:
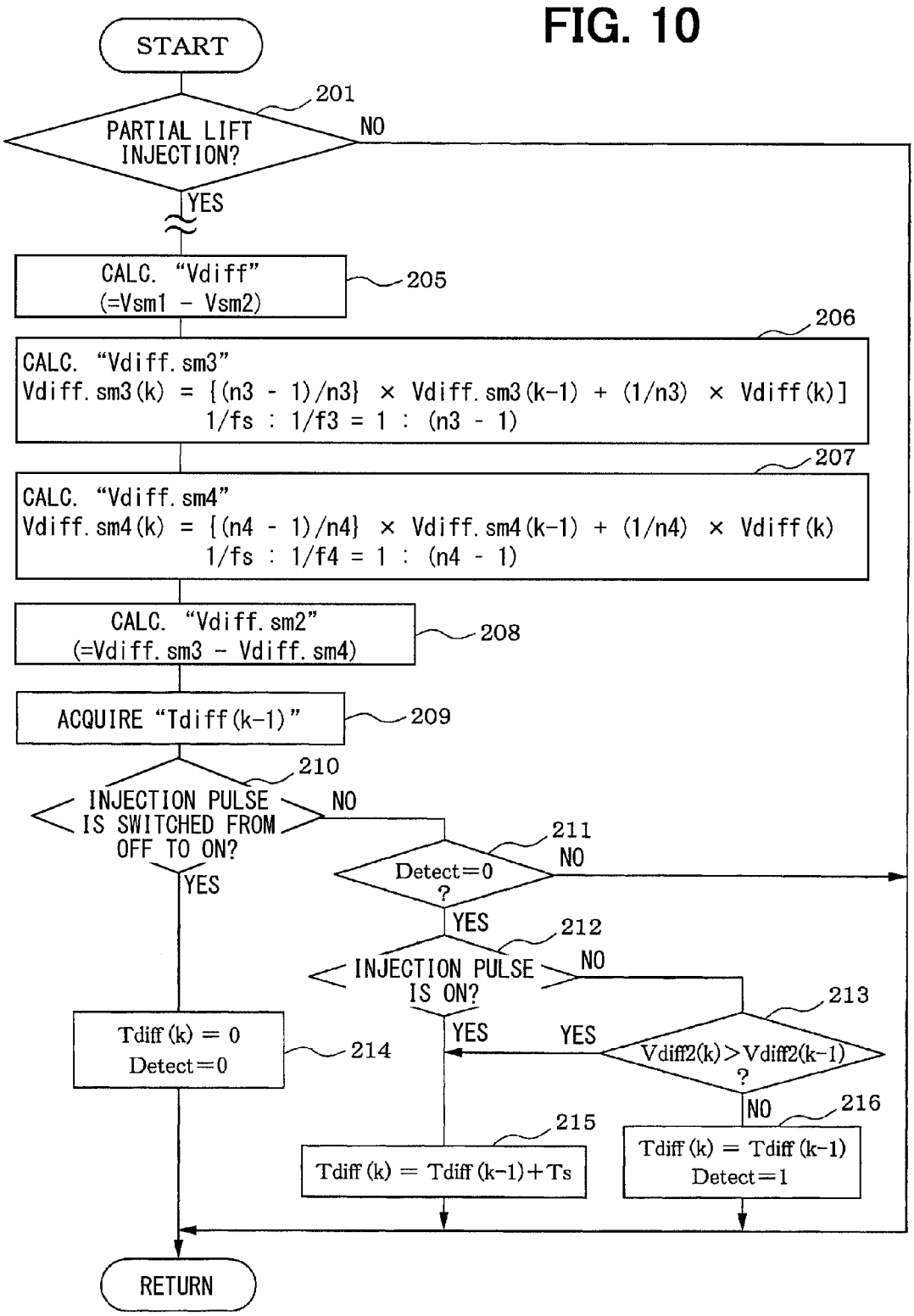
FIG. 10 is a flowchart illustrating a procedure of a voltage inflection time calculation routine in a second embodiment.
Figure 11:
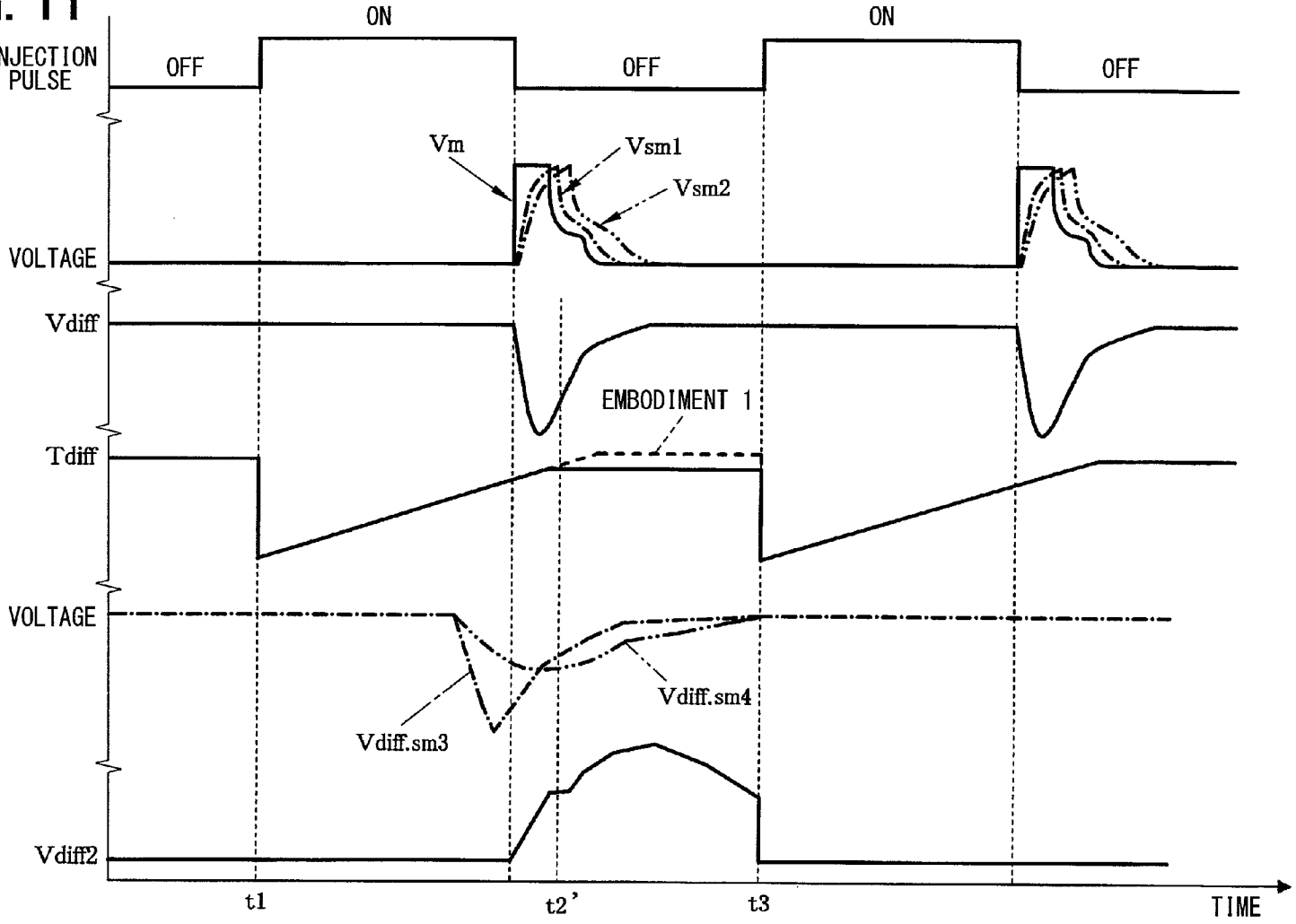
FIG. 11 is a time chart illustrating a voltage inflection time calculation in the second embodiment.

A process of steps 201 to 205 in the routine of FIG. 10 executed in the second embodiment is the same as the process of steps 101 to 105 in the routine of FIG. 8 described in the first embodiment.

In the voltage inflection time calculation routine of FIG. 10, if the partial lift injection is determined to be being performed, a first filtered voltage Vsm1 being a negative terminal voltage Vm of the fuel injection valve 21 filtered by a first low-pass filter is calculated, and a second filtered voltage Vsm2 being the negative terminal voltage Vm of the fuel injection valve 21 filtered by a second low-pass filter is calculated (steps 201 to 204). Subsequently, a difference Vdiff (=Vsm1−Vsm2) between the first filtered voltage Vsm1 and the second filtered voltage Vsm2 is calculated (step 205).

Subsequently, in step 206, there is calculated a third filtered voltage Vdiff.sm3 being the difference Vdiff filtered by a third low-pass filter having a third frequency f3 as a cutoff frequency, the third frequency f3 being lower than a frequency of a noise component (i.e., a low-pass filter having a passband being a frequency band lower than the cutoff frequency f3).

The third low-pass filter is a digital filter implemented by Formula (5) to obtain a current value Vdiff.sm3(k) of the third filtered voltage using a previous value Vdiff.sm3(k−1) of the third filtered voltage and a current value Vdiff(k) of the difference.

$$Vdiff.sm3(k)=\{(n3-1)/n3\}\times Vdiff.sm3(k-1)+(1/n3)\times Vdiff(k) \quad (5)$$

The time constant n3 of the third low-pass filter is set such that the relationship of Formula (6) is satisfied, where fs (=1/Ts) is a sampling frequency of the negative terminal voltage Vm, and f3 is the cutoff frequency of the third low-pass filter.

$$1/fs:1/f3=1:(n3-1) \quad (6)$$

Consequently, it is possible to easily calculate the third filtered voltage Vdiff.sm3 filtered by the third low-pass filter having the third frequency f3 as the cutoff frequency, the third frequency f3 being lower than the frequency of the noise component.

Subsequently, in step 207, a fourth filtered voltage Vdiff.sm4 being the difference Vdiff filtered by a fourth low-pass filter having a fourth frequency f4 as a cutoff frequency, the fourth frequency f4 being lower than the third frequency f3 (i.e., a low-pass filter having a passband being a frequency band lower than the cutoff frequency f4).

The fourth low-pass filter is a digital filter implemented by Formula (7) to obtain a current value Vdiff.sm4(k) of the fourth filtered voltage using a previous value Vdiff.sm4(k−1) of the fourth filtered voltage and the current value Vdiff(k) of the difference.

$$Vdiff.sm4(k)=\{(n4-1)/n4\}\times Vdiff.sm4(k-1)+(1/n4)\times Vdiff(k) \quad (7)$$

The time constant n4 of the fourth low-pass filter is set such that the relationship of Formula (8) is satisfied, where fs (=1/Ts) is the sampling frequency of the negative terminal voltage Vm, and f4 is the cutoff frequency of the fourth low-pass filter.

$$1/fs:1/f4=1:(n4-1) \quad (8)$$

Consequently, it is possible to easily calculate the fourth filtered voltage Vdiff.sm4 filtered by the fourth low-pass filter having the fourth frequency f4 as the cutoff frequency, the fourth frequency f4 being lower than the third frequency f3.

The cutoff frequency f3 of the third low-pass filter is set to a frequency higher than the cutoff frequency f1 of the first low-pass filter, and the cutoff frequency f4 of the fourth low-pass filter is set to a frequency lower than the cutoff frequency f2 of the second low-pass filter (i.e., a relationship of f3>f1>f2>f4 is satisfied).

Subsequently, in step 208, a difference between the third filtered voltage Vdiff.sm3 and the fourth filtered voltage Vdiff.sm4 is calculated as the second order differential Vdiff2 (=Vdiff.sm3−Vdiff.sm4), and then the previous value T diff(k−1) of the voltage inflection time is acquired in step 209.

Subsequently, in step 210, whether or not the injection pulse is switched from off to on at the current timing is determined. If the injection pulse is determined to be switched from off to on at the current timing in step 210, then in step 214 a current value Tdiff(k) of the voltage inflection time is reset to "0", and a completion flag Detect is reset to "0".

$$Tdiff(k)=0$$

$$Detect(k)=0$$

If the injection pulse is determined to be switched from off to on at the current timing in step 210, then in step 211 whether or not the completion flag Detect is "0" is determined. If the completion flag Detect is determined to be "0", then in step 212 whether or not the injection pulse is on is determined.

If the injection pulse is determined to be on in step 212, then in step 215 a predetermined value Ts (the calculation period of this routine) is added to the previous value Tdiff(k−1) of the voltage inflection time to obtain the current value Tdiff(k) of the voltage inflection time, so that the voltage inflection time Tdiff is counted up.

$$Tdiff(k)=Tdiff(k-1)+Ts$$

If the injection pulse is determined to be not on (or the injection pulse is off) in step 212, then in step 213 whether or not the second order differential Vdiff2 increases is determined based on whether or not the current value Vdiff2(k) of the second order differential is larger than the previous value Vdiff2(k−1). If the second order differential Vdiff2 no longer increases, the second order differential Vdiff2 is determined to have an extreme value.

If the current value Vdiff2(k) of the second order differential is determined to be larger than the previous value Vdiff2(k−1) (the second order differential Vdiff2 is determined to increase) in step 213, then in step 215 the voltage inflection time Tdiff is continuously counted up.

If the current value Vdiff2(k) of the second order differential is determined to be equal to or smaller than the previous value Vdiff2(k−1) (the second order differential Vdiff2 is determined not to increase) in step 213, calculation of the voltage inflection time Tdiff is determined to be completed, and then in step 216 the current value Tdiff(k) of the voltage inflection time is maintained to the previous value Tdiff(k−1), and the completion flag Detect is set to "1".

$$Tdiff(k)=Tdiff(k-1)$$

$$Detect=1$$

If the completion flag Detect is determined to be 1, while the current value Tdiff(k) of the voltage inflection time is maintained to the previous value Tdiff(k−1), this routine is finished.

Consequently, time from a timing (reference timing), at which the injection pulse is switched from off to on, to a timing, at which the second order differential Vdiff2 has the extreme value (at which the second order differential Vdiff2 no longer increases), is calculated as the voltage inflection time Tdiff, and the calculated value of the voltage inflection time Tdiff is maintained until the next reference timing.

An execution example of calculation of the voltage inflection time in the second embodiment is now described with reference to a time chart of FIG. 11.

During the partial lift injection (at least after off of the injection pulse of the partial lift injection), the first filtered voltage Vsm1 and the second filtered voltage Vsm2 are calculated, and the difference Vdiff between the first filtered voltage Vsm1 and the second filtered voltage Vsm2 is calculated.

Furthermore, the third filtered voltage Vdiff.sm3 being the difference Vdiff filtered by the third low-pass filter is calculated, and the fourth filtered voltage Vdiff.sm4 being the difference Vdiff filtered by the fourth low-pass filter is calculated. In addition, a difference between the third filtered voltage Vdiff.sm3 and the fourth filtered voltage Vdiff.sm4 is calculated as a second order differential Vdiff2 (=Vdiff.sm3−Vdiff.sm4).

The voltage inflection time Tdiff is reset to "0" at a timing (reference timing) t1 when the injection pulse is switched from off to on, and then calculation of the voltage inflection time Tdiff is started, and the voltage inflection time Tdiff is repeatedly counted up with the predetermined calculation period Ts.

Subsequently, the calculation of the voltage inflection time Tdiff is completed at a timing t2' when the second order differential Vdiff2 has an extreme value (the second order differential Vdiff2 no longer increases) after off of the injection pulse. Consequently, time from the timing (reference timing) t1, at which the injection pulse is switched from off to on, to the timing t2', at which the second order differential Vdiff2 has an extreme value, is calculated as the voltage inflection time Tdiff.

The calculated value of the voltage inflection time Tdiff is maintained until the next reference timing t3, during which (during a period from the calculation completion timing t2' of the voltage inflection time Tdiff to the next reference timing t3) the engine control microcomputer 35 acquires the voltage inflection time Tdiff from the injector drive IC 36.

In the second embodiment, the third filtered voltage Vdiff.sm3 being the difference Vdiff filtered by the third low-pass filter is calculated, and the fourth filtered voltage Vdiff.sm4 being the difference Vdiff filtered by the fourth low-pass filter is calculated. In addition, the difference between the third filtered voltage Vdiff.sm3 and the fourth filtered voltage Vdiff.sm4 is calculated as the second order differential Vdiff2. The voltage inflection time Tdiff is calculated with the timing, at which the second order differential Vdiff2 has an extreme value (the second order differential Vdiff2 no longer increases), as a timing when the difference Vdiff has an inflection point. Consequently, it is possible to accurately calculate the voltage inflection time Tdiff that varies depending on the valve-closing timing of the fuel injection valve 21, and prevent the voltage inflection time Tdiff from being affected by offset of a terminal voltage waveform due to circuit variations.

Third Embodiment

A third embodiment of the disclosure is now described with reference to FIGS. 12 and 13. However, portions substantially the same as those in the first embodiment are not or briefly described, and differences from the first embodiment are mainly described.

In the first embodiment, the voltage inflection time Tdiff is calculated with the reference timing being the timing when the injection pulse of the partial lift injection is switched from off to on. In the third embodiment, the ECU 30 executes a voltage inflection time calculation routine of FIG. 12 described later to calculate the voltage inflection time Tdiff with a reference timing being a timing when the injection pulse of the partial lift injection is switched from on to off.

Figure 12:
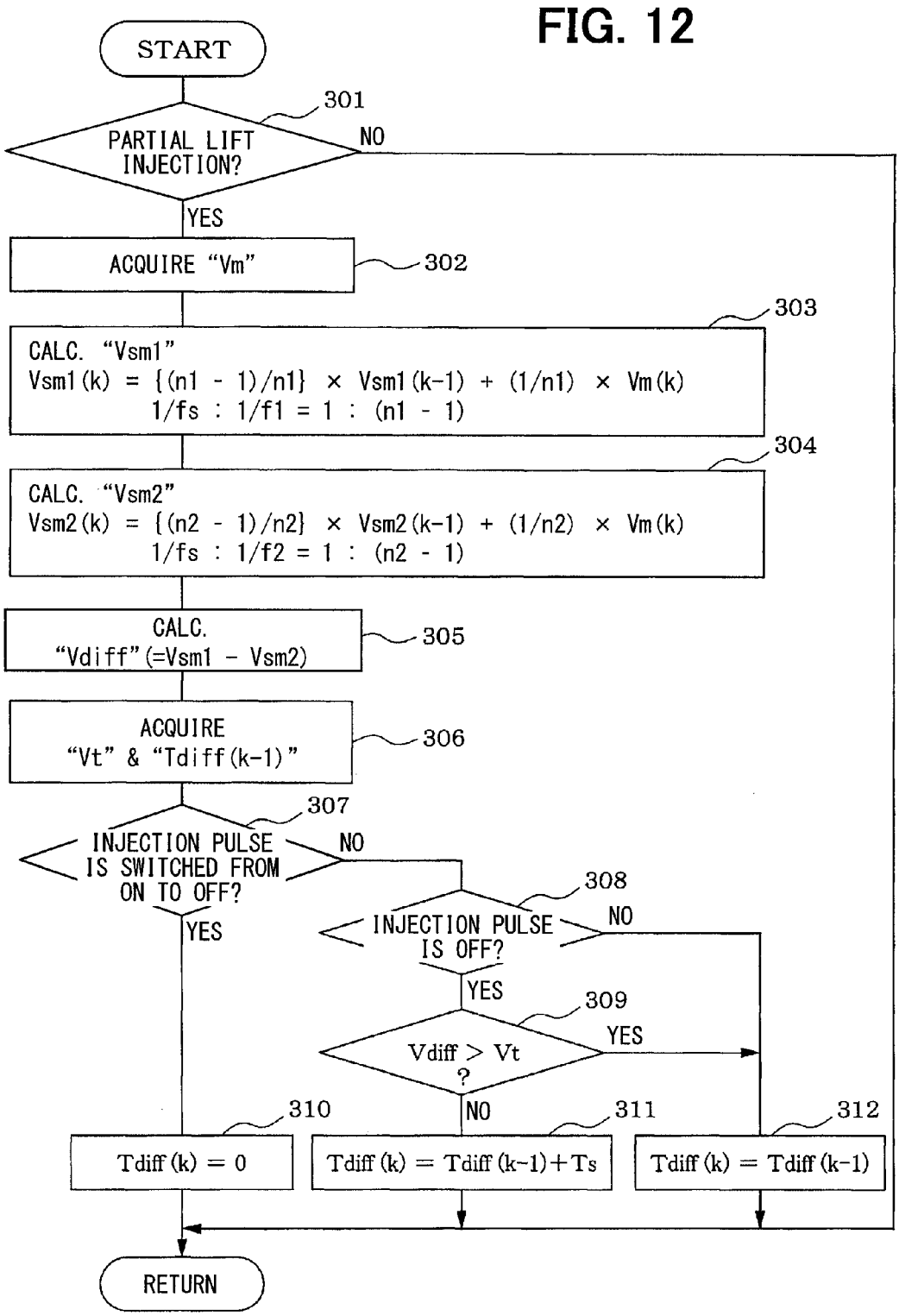
FIG. 12 is a flowchart illustrating a procedure of a voltage inflection time calculation routine in a third embodiment.
Figure 13:
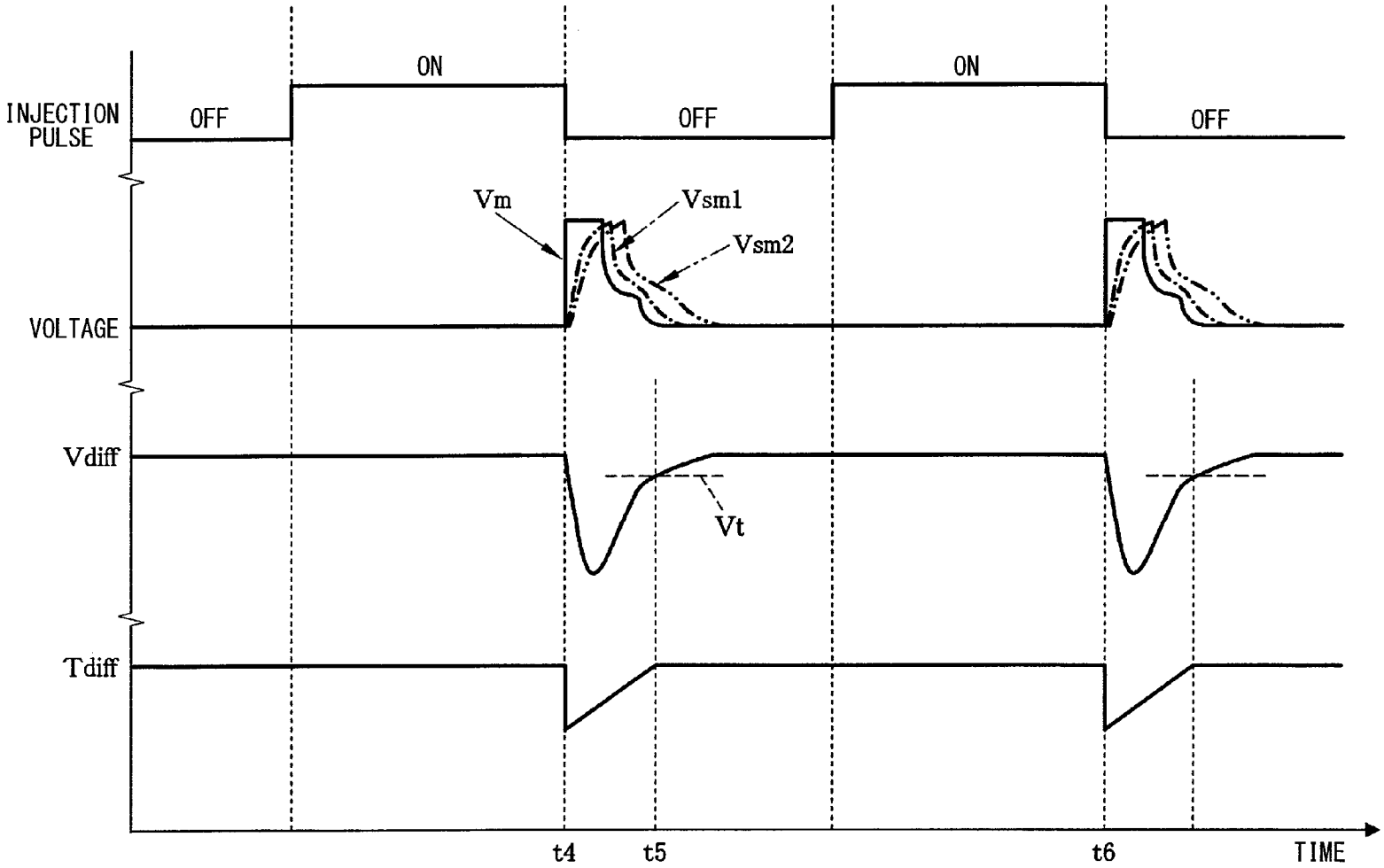
FIG. 13 is a time chart illustrating a voltage inflection time calculation in the third embodiment.

A process of steps 301 to 306 in the routine of FIG. 12 executed in the third embodiment is the same as the process of steps 101 to 106 in the routine of FIG. 8 described in the first embodiment.

In the voltage inflection time calculation routine of FIG. 12, if the partial lift injection is determined to be being performed, a first filtered voltage Vsm1 being a negative terminal voltage Vm of the fuel injection valve 21 filtered by a first low-pass filter is calculated, and a second filtered voltage Vsm2 being the negative terminal voltage Vm of the fuel injection valve 21 filtered by a second low-pass filter is calculated (steps 301 to 304).

Subsequently, a difference Vdiff between the first filtered voltage Vsm1 and the second filtered voltage Vsm2 is calculated, and then a threshold Vt and a previous value Tdiff(k−1) of the voltage inflection time are acquired (steps 305, 306).

Subsequently, in step 307, whether or not the injection pulse is switched from on to off at the current timing is determined. If the injection pulse is determined to be switched from on to off at the current timing in step 307, then in step 310 a current value Tdiff(k) of the voltage inflection time is reset to "0".

$$Tdiff(k)=0$$

If the injection pulse is determined to be switched from on to off at the current timing in step 307, then in step 308 whether or not the injection pulse is off is determined. If the injection pulse is determined to be off in step 408, then in step 309 whether or not the difference Vdiff between the first filtered voltage Vsm1 and the second filtered voltage Vsm2 exceeds the threshold Vt (whether or not the difference Vdiff inversely becomes larger than the threshold Vt) is determined.

If the difference Vdiff between the first filtered voltage Vsm1 and the second filtered voltage Vsm2 is determined not to exceed the threshold Vt in step 309, then in step 311 a predetermined value Ts (the calculation period of this routine) is added to the previous value Tdiff(k−1) of the voltage inflection time to obtain the current value Tdiff(k) of the voltage inflection time, so that the voltage inflection time Tdiff is counted up.

$$Tdiff(k)=Tdiff(k-1)+Ts$$

If the difference Vdiff between the first filtered voltage Vsm1 and the second filtered voltage Vsm2 is determined to exceed the threshold Vt in step 309, calculation of the voltage inflection time Tdiff is determined to be completed, and in step 312 the current value Tdiff(k) of the voltage inflection time is maintained to the previous value Tdiff(k−1).

$$Tdiff(k)=Tdiff(k-1)$$

Consequently, time from the timing (reference timing), at which the injection pulse is switched from on to off, to the timing, at which the difference Vdiff exceeds the threshold Vt, is calculated as the voltage inflection time Tdiff.

If the injection pulse is determined to be not off (i.e., the injection pulse is on) in step 308, the current value Tdiff(k) of the voltage inflection time is continuously maintained to the previous value Tdiff(k−1), and the calculated value of the voltage inflection time Tdiff is maintained until the next reference timing.

An execution example of calculation of the voltage inflection time in the third embodiment is now described with reference to a time chart of FIG. 13.

During the partial lift injection (at least after off of the injection pulse of the partial lift injection), the first filtered voltage Vsm1 and the second filtered voltage Vsm2 are calculated, and the difference Vdiff between the first filtered voltage Vsm1 and the second filtered voltage Vsm2 is calculated.

The voltage inflection time Tdiff is reset to "0" at a timing (reference timing) t4 when the injection pulse is switched from on to off, and then calculation of the voltage inflection time Tdiff is started, and the voltage inflection time Tdiff is repeatedly counted up with the predetermined calculation period Ts.

The calculation of the voltage inflection time Tdiff is completed at a timing t5 when the difference Vdiff between the first filtered voltage Vsm1 and the second filtered voltage Vsm2 exceeds the threshold Vt after off of the injection pulse. Consequently, time from the timing (reference timing) t4, at which the injection pulse is switched from on to off, to the timing t5, at which the difference Vdiff exceeds the threshold Vt, is calculated as the voltage inflection time Tdiff.

The calculated value of the voltage inflection time Tdiff is maintained until the next reference timing t6, during which (during a period from the calculation completion timing t5 of the voltage inflection time Tdiff to the next reference timing t6), the engine control microcomputer 35 acquires the voltage inflection time Tdiff from the injector drive IC 36.

In the third embodiment, the voltage inflection time Tdiff is calculated with the reference timing being the timing when the injection pulse of the partial lift injection is switched from on to off; hence, the voltage inflection time Tdiff can be accurately calculated with reference to the timing when the injection pulse is switched from on to off. Moreover, a period during which the calculated value of the voltage inflection time Tdiff is maintained can be lengthened compared with the case where the timing when the injection pulse is switched from off to on is used as a reference timing (first embodiment), so that the period during which the engine control microcomputer 35 can acquire the voltage inflection time Tdiff can be further lengthened.

In the third embodiment, time from the timing, at which the injection pulse is switched from off to on, to the timing, at which the difference Vdiff exceeds the threshold Vt, is calculated as the voltage inflection time Tdiff. However, time from the timing, at which the injection pulse is switched from off to on, to the timing, at which the second order differential Vdiff2 has an extreme value, may be calculated as the voltage inflection time Tdiff.

Fourth Embodiment

A fourth embodiment of the disclosure is now described with reference to FIGS. 14 and 15. However, portions substantially the same as those in the first embodiment are not or briefly described, and differences from the first embodiment are mainly described.

In the first embodiment, the voltage inflection time Tdiff is calculated with the reference timing being the timing when the injection pulse of the partial lift injection is switched from off to on. In the fourth embodiment, the ECU 30 executes a voltage inflection time calculation routine of FIG. 14 described later, so that the voltage inflection time Tdiff is calculated with a reference timing being a timing when the negative terminal voltage Vm of the fuel injection valve 21 becomes lower than a predetermined value Voff after off of the injection pulse of the partial lift injection.

Figure 14:
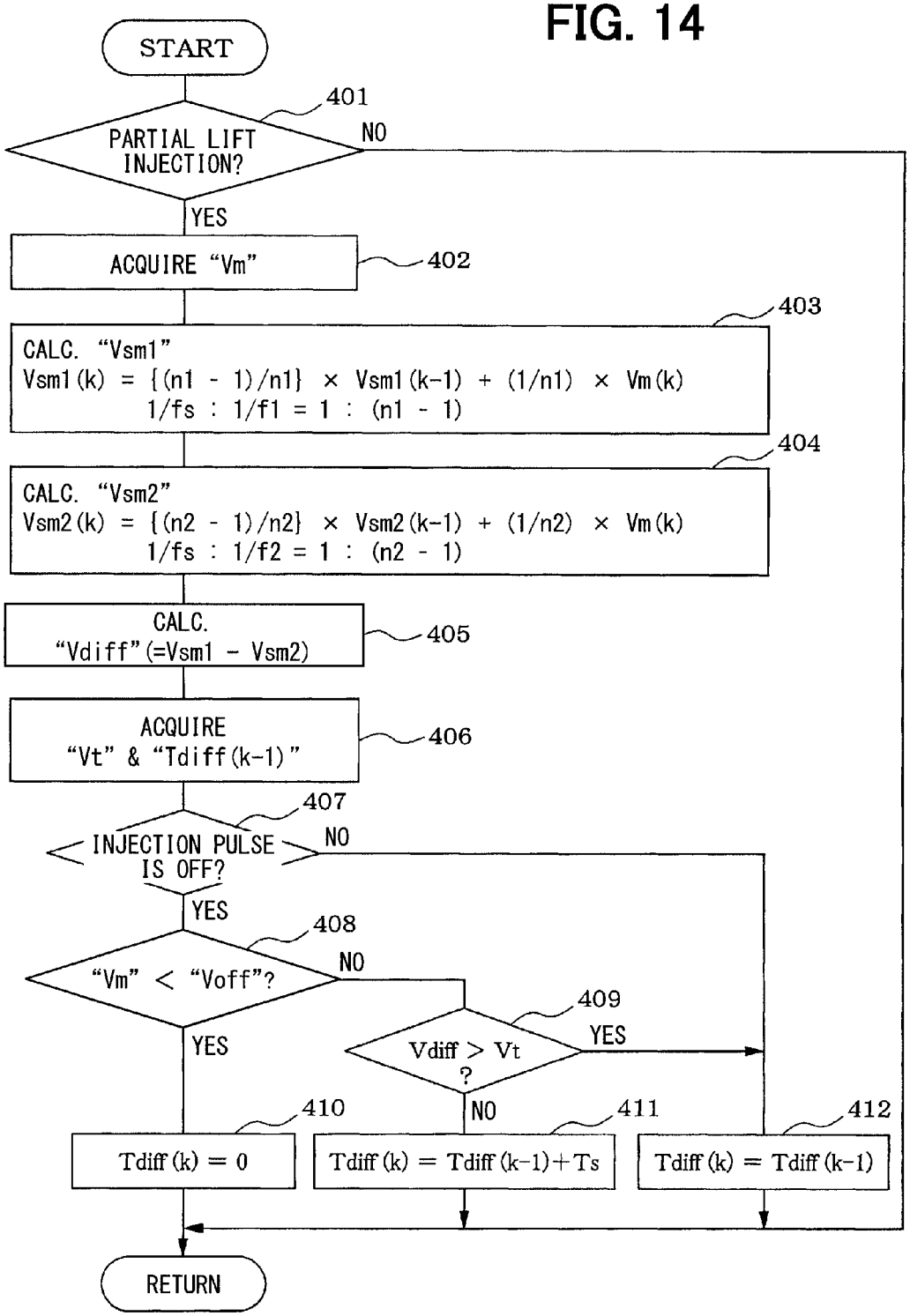
FIG. 14 is a flowchart illustrating a procedure of a voltage inflection time calculation routine in a fourth embodiment.
Figure 15:
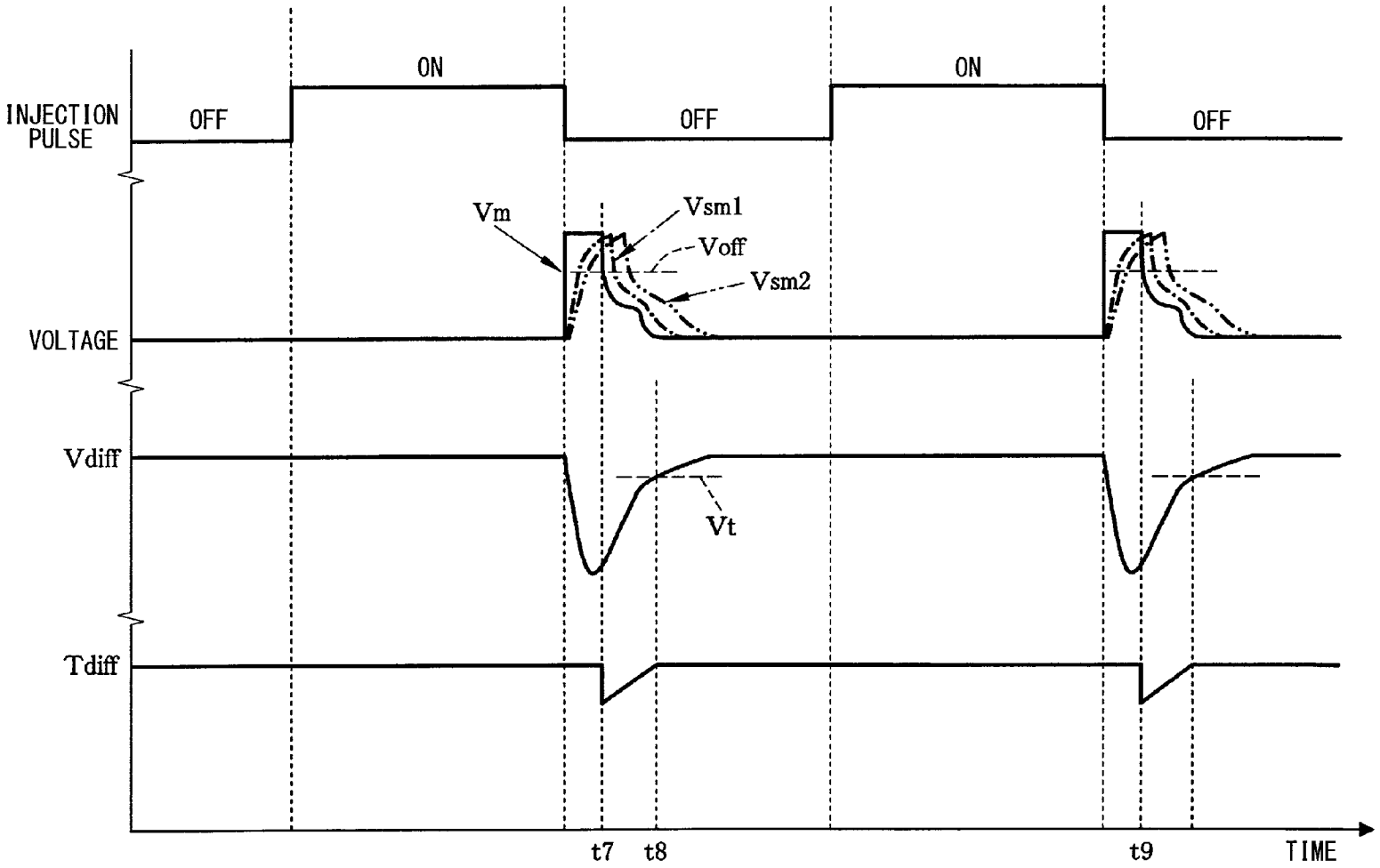
FIG. 15 is a time chart illustrating a voltage inflection time calculation in the fourth embodiment.

A process of steps 401 to 406 in the routine of FIG. 14 executed in the fourth embodiment is the same as the process of steps 101 to 106 in the routine of FIG. 8 described in the first embodiment.

In the voltage inflection time calculation routine of FIG. 14, if the partial lift injection is determined to be being performed, a first filtered voltage Vsm1 being a negative terminal voltage Vm of the fuel injection valve 21 filtered by a first low-pass filter is calculated, and a second filtered voltage Vsm2 being the negative terminal voltage Vm of the fuel injection valve 21 filtered by a second low-pass filter is calculated (steps 401 to 404).

Subsequently, a difference Vdiff between the first filtered voltage Vsm1 and the second filtered voltage Vsm2 is calculated, and then a threshold Vt and a previous value Tdiff(k−1) of the voltage inflection time are acquired (steps 405, 406).

Subsequently, in step 407, whether or not the injection pulse is off is determined. If the injection pulse is determined to be off in step 407, then in step 408 whether or not the negative terminal voltage Vm of the fuel injection valve 21 becomes lower than a predetermined value Voff (inversely becomes smaller than the predetermined value Voff) at the current timing is determined.

If the negative terminal voltage Vm of the fuel injection valve 21 is determined to become lower than the predetermined value Voff at the current timing in step 408, then in step 410 a current value Tdiff(k) of the voltage inflection time is reset to "0".

$$Tdiff(k)=0$$

If the negative terminal voltage Vm of the fuel injection valve 21 is determined not to become lower than the predetermined value Voff at the current timing in step 408, then in step 409 whether or not the difference Vdiff between the first filtered voltage Vsm1 and the second filtered voltage Vsm2 exceeds the threshold Vt (whether or not the difference Vdiff inversely becomes larger than the threshold Vt) is determined.

If the difference Vdiff between the first filtered voltage Vsm1 and the second filtered voltage Vsm2 is determined not to exceed the threshold Vt in step 409, then in step 411 a predetermined value Ts (the calculation period of this routine) is added to the previous value Tdiff(k−1) of the voltage inflection time to obtain a current value Tdiff(k) of the voltage inflection time, so that the voltage inflection time Tdiff is counted up.

$$Tdiff(k)=Tdiff(k-1)+Ts$$

If the difference Vdiff between the first filtered voltage Vsm1 and the second filtered voltage Vsm2 is determined to exceed the threshold Vt in step 509, calculation of the voltage inflection time Tdiff is determined to be completed, and in step 512 the current value Tdiff(k) of the voltage inflection time is maintained to the previous value Tdiff(k−1).

$$Tdiff(k)=Tdiff(k-1)$$

Consequently, time from the timing (reference timing), at which the negative terminal voltage Vm of the fuel injection valve 21 becomes lower than the predetermined value Voff after off of the injection pulse, to the timing, at which the difference Vdiff exceeds the threshold Vt, is calculated as the voltage inflection time Tdiff.

If the injection pulse is determined to be not off (i.e., the injection pulse is on) in step 407, the current value Tdiff(k) of the voltage inflection time is continuously maintained to the previous value Tdiff(k−1), and the calculated value of the voltage inflection time Tdiff is maintained until the next reference timing.

An execution example of calculation of the voltage inflection time in the fourth embodiment is now described with reference to a time chart of FIG. 15.

During the partial lift injection (at least after off of the injection pulse of the partial lift injection), the first filtered voltage Vsm1 and the second filtered voltage Vsm2 are calculated, and the difference Vdiff between the first filtered voltage Vsm1 and the second filtered voltage Vsm2 is calculated.

The voltage inflection time Tdiff is reset to "0" at a timing (reference timing) t7 when the negative terminal voltage Vm of the fuel injection valve 21 becomes lower than the predetermined value Voff after off of the injection pulse, and then calculation of the voltage inflection time Tdiff is started, and the voltage inflection time Tdiff is repeatedly counted up with the predetermined calculation period Ts.

The calculation of the voltage inflection time Tdiff is completed at a timing t8 when the difference Vdiff between the first filtered voltage Vsm1 and the second filtered voltage Vsm2 exceeds the threshold Vt after off of the injection pulse. Consequently, time from the timing (reference timing) t7, at which the negative terminal voltage Vm of the fuel injection valve 21 becomes lower than the predetermined value Voff after off of the injection pulse, to the timing t8, at which the difference Vdiff exceeds the threshold Vt, is calculated as the voltage inflection time Tdiff.

The calculated value of the voltage inflection time Tdiff is maintained until the next reference timing t9, during which (during a period from the calculation completion timing t8 of the voltage inflection time Tdiff to the next reference timing t9), the engine control microcomputer 35 acquires the voltage inflection time Tdiff from the injector drive IC 36.

In the fourth embodiment, the voltage inflection time Tdiff is calculated with the reference timing being the timing when the negative terminal voltage Vm of the fuel injection valve 21 becomes lower than the predetermined value Voff after off of the injection pulse of the partial lift injection; hence, the voltage inflection time Tdiff can be accurately calculated with reference to the timing when the negative terminal voltage Vm of the fuel injection valve 21 becomes lower than the predetermined value Voff after off of the injection pulse. Moreover, a period during which the calculated value of the voltage inflection time Tdiff is maintained can be lengthened compared with the case where the timing when the injection pulse is switched from off to on is used as the reference timing (first embodiment), so that the period during which the engine control microcomputer 35 can acquire the voltage inflection time Tdiff can be further lengthened.

In the fourth embodiment, time from the timing, at which the negative terminal voltage Vm becomes lower than the predetermined value Voff, to the timing, at which the difference Vdiff exceeds the threshold Vt, is calculated as the voltage inflection time Tdiff. However, time from the timing, at which the negative terminal voltage Vm becomes lower than the predetermined value Voff, to the timing, at which the second order differential Vdiff2 has an extreme value, may be calculated as the voltage inflection time Tdiff.

Fifth Embodiment

Referring to FIGS. 16 to 22, a fifth embodiment will be described hereinafter. In the fifth embodiment, the same parts and components as those in the first embodiment are indicated with the same reference numerals and the same descriptions will not be reiterated.

When the negative terminal voltage Vm of the fuel injection valve 21 fluctuates due to a variation in circuit, the voltage inflection time Tdiff also fluctuates which may cause a deterioration in correction of the injection pulse.

Figure 16:
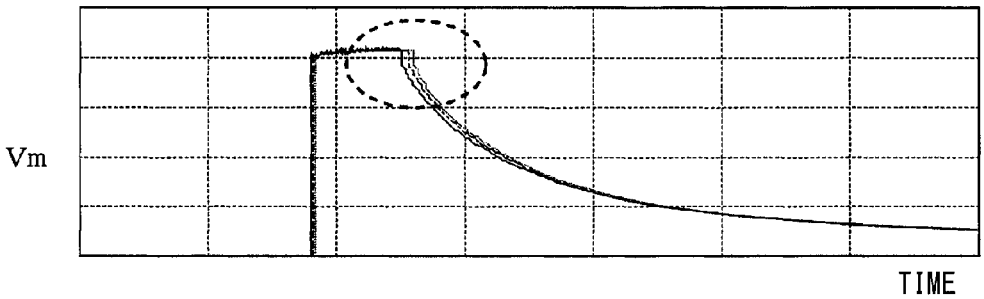
FIG. 16 is a time charts explaining variation factors of the voltage inflection time.
Figure 16:
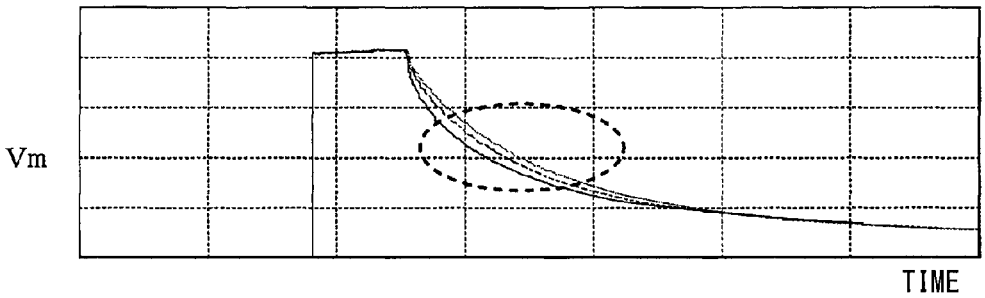
Figure 16:
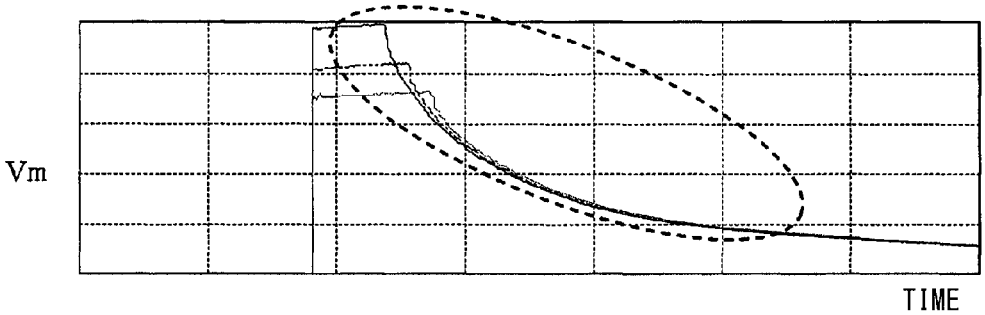

As shown in FIGS. 16(*a*), (*b*), (*c*), following factors (I) to (III) can be considered as factors of the variation in voltage inflection time Tdiff (I) Variation in Falling Timing of Negative Terminal Voltage Vm As shown in FIG. 16(*a*), due to a circuit variation (for example, pulse width, inductance, impedance, pull down resistor), the falling timing of the negative terminal voltage may be varied after the injection pulse is off. When the falling timing of the negative terminal voltage Vm is varied, a time offset deviation (offset deviation of a terminal voltage waveform) of the negative terminal voltage Vm will arise. For this reason, in the case that the voltage inflection time Tdiff is computed based on an injection pulse switching, the voltage inflection time Tdiff may be varied.

(II) Variation in Response Speed of Negative Terminal Voltage Vm

As shown in FIG. 16(*b*), due to a circuit variation (for example, variation of the capacitor between terminals), the response speed of negative terminal voltage Vm may be varied after the injection pulse is off. The variation in response speed of negative terminal voltage Vm causes a variation in falling negative terminal voltage Vm. The voltage inflection time Tdiff may be varied.

(III) Variation in Maximum of Negative Terminal Voltage Vm

As shown in FIG. 16(*c*), due to a circuit variation (for example, flyback voltage variation), the maximum value of the negative terminal voltage Vm may be varied after the injection pulse is off. The variation in maximum value of negative terminal voltage Vm causes a variation in falling negative terminal voltage Vm. The voltage inflection time Tdiff may be varied.

Figure 20:
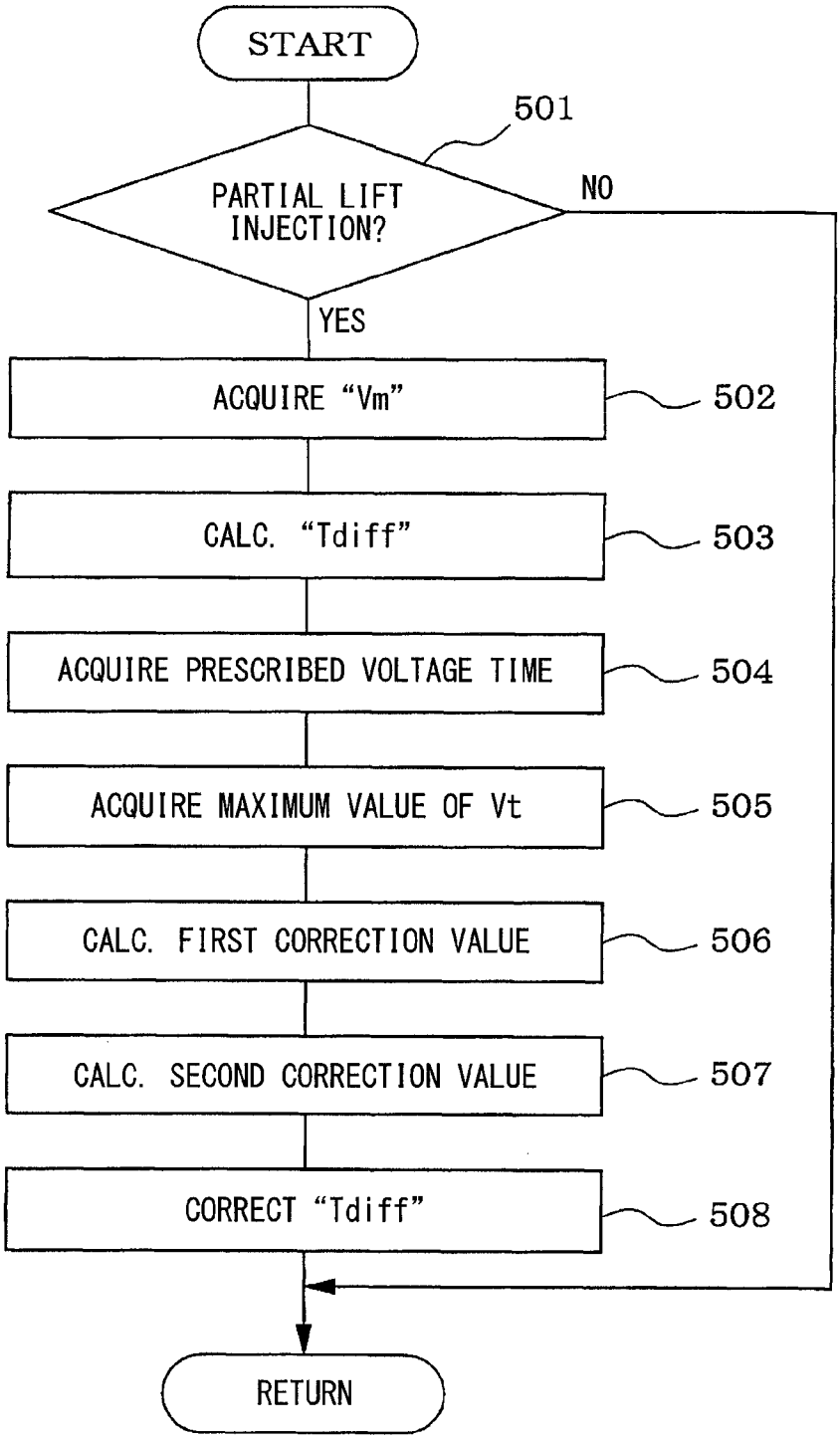
FIG. 20 is a flowchart illustrating a procedure of a voltage inflection time calculation routine in a fifth embodiment.
Figure 21:
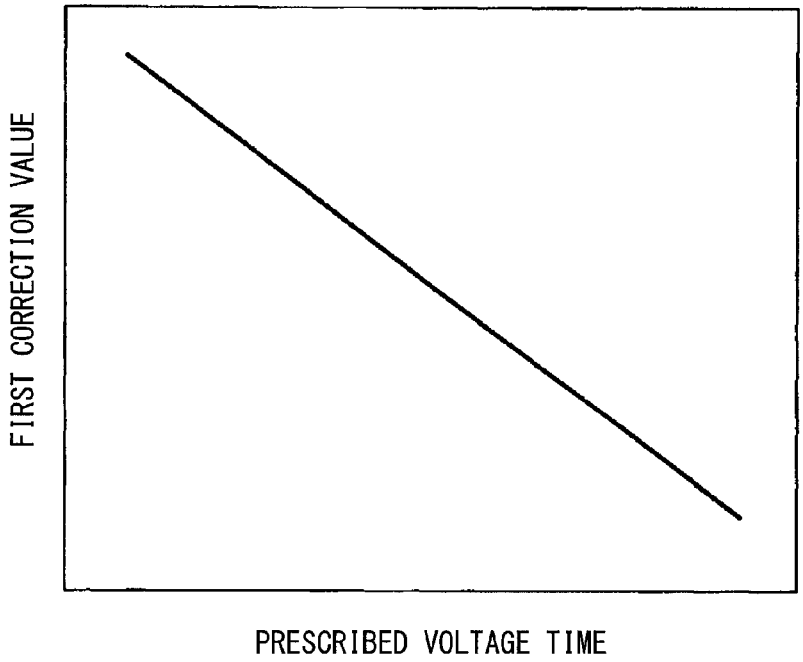
FIG. 21 is a chart showing a first correction value map.
Figure 22:
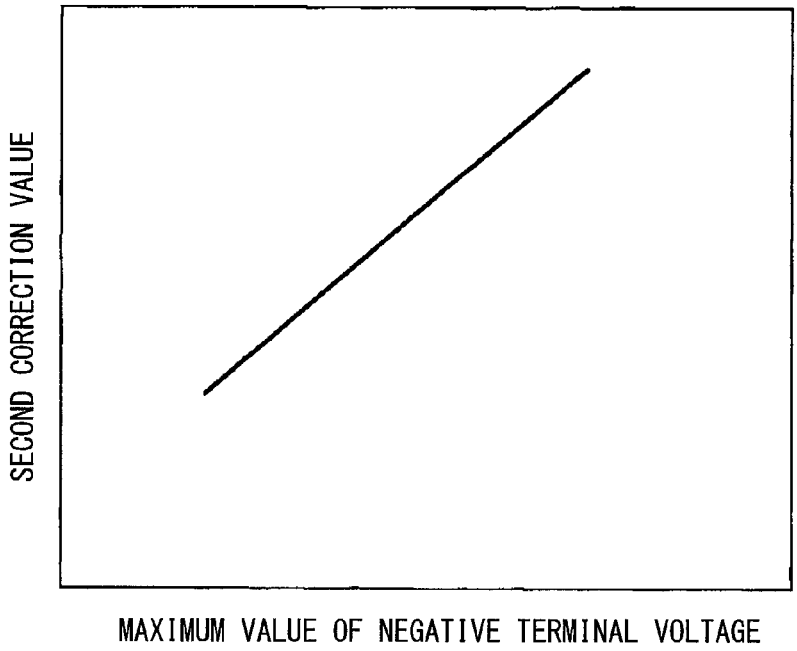
FIG. 22 is a chart showing a second correction value map.

In the fifth embodiment, the ECU 30 performs a voltage inflection time calculation routine shown in FIG. 20.

Figure 17:
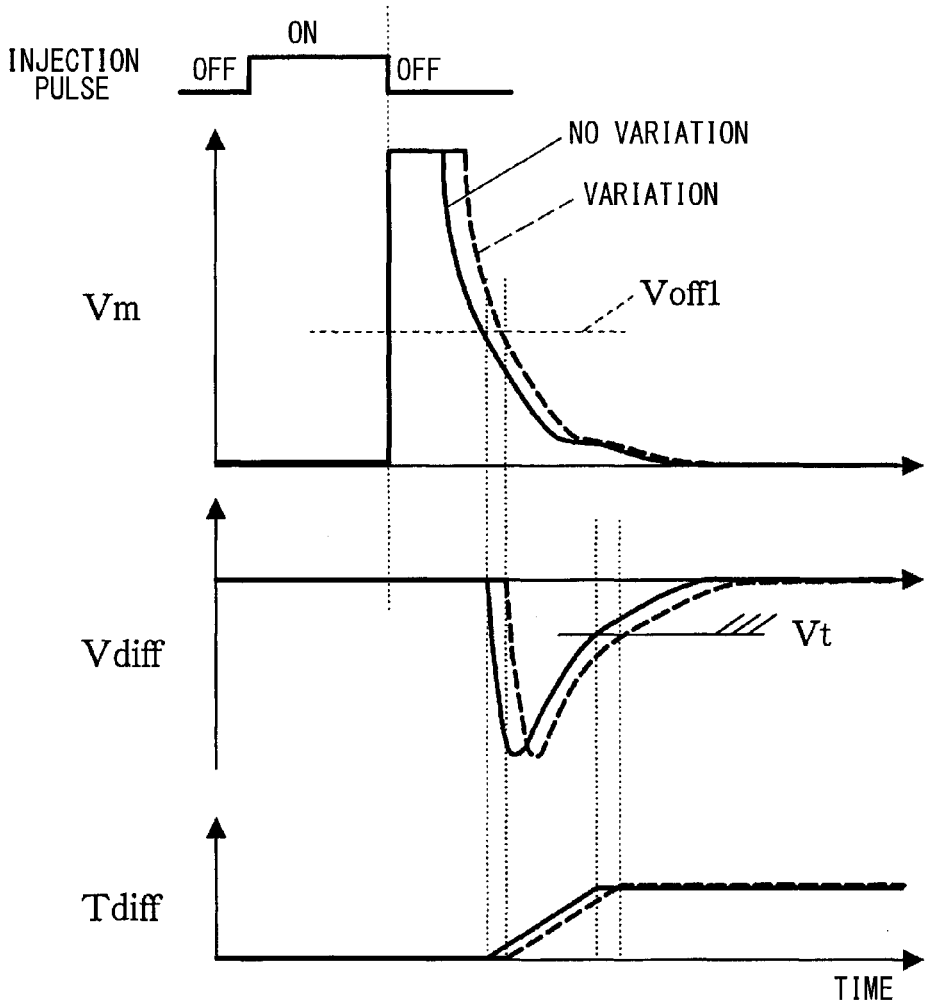
FIG. 17 is a time chart explaining a countermeasure to reduce a variation in a falling timing of a minus-terminal voltage.

As shown in FIG. 17, the ECU 30 computes the voltage inflection time Tdiff based on a reference timing at which the negative terminal voltage Vm falls below the specified value Voff1, after the injection pulse is off. That is, the voltage inflection time Tdiff is a time period from the negative terminal voltage Vm falls below the specified value Voff1 until the difference Vdiff exceeds a threshold Vt.

When the falling timing of the negative terminal voltage Vm is varied, the timing of the negative terminal voltage falling below the specified value Voff1 is also varied. Therefore, the negative terminal voltage Vm is computed based the reference timing at which the negative terminal voltage Vm falls below the specified value Voff1. Even if time offset deviation of the negative terminal voltage Vm arises with the variation in the falling timing of the negative terminal voltage Vm, the voltage inflection point time Tdiff can be computed.

Moreover, the ECU 30 obtains the information ("terminal voltage change information") about the variation of the negative terminal voltage Vm after the injection pulse is off. According to the terminal voltage change information, the ECU 30 corrects the voltage inflection point time Tdiff.

Figure 18:
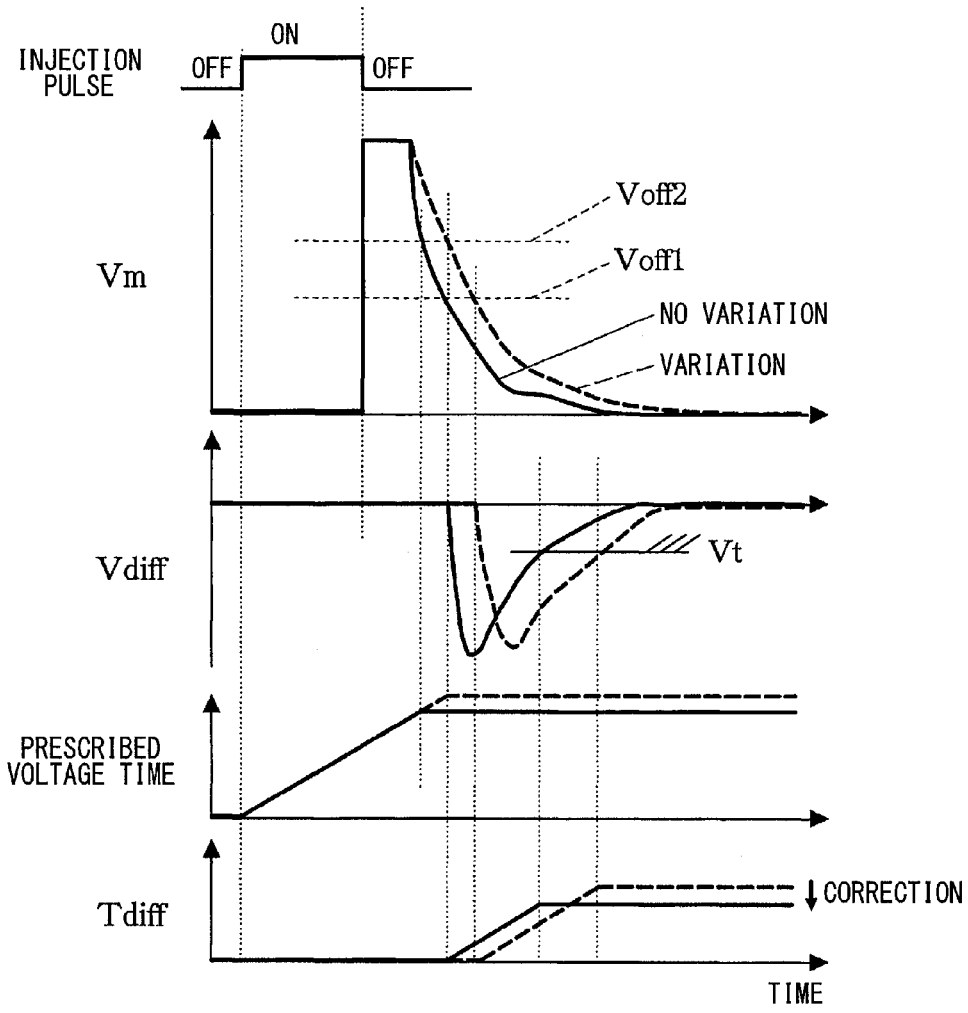
FIG. 18 is a time chart explaining a countermeasure to a variation in a response speed of the minus-terminal voltage.

Specifically, as shown in FIG. 18, in order to reduce the variation in response speed of the negative terminal voltage Vm, the ECU 30 obtains a prescribed voltage time which is a time period from the injection pulse becomes on until the negative terminal voltage Vm falls below the specified value Voff2. The specified value Voff2 may be equal to the specified value Voff1. Alternatively, the specified value Voff2 may be different from the specified value Voff1. Then, based on the prescribed voltage time, the voltage inflection point time Tdiff is corrected.

Since the response speed of the negative terminal voltage Vm varies along with the prescribed voltage time, the prescribed voltage time reflects the response speed of the negative terminal voltage Vm. Therefore, by correcting the voltage inflection point time Tdiff according to the prescribed voltage time, the voltage inflection point time Tdiff can be corrected according to the response speed of the negative terminal voltage Vm.

Figure 19:
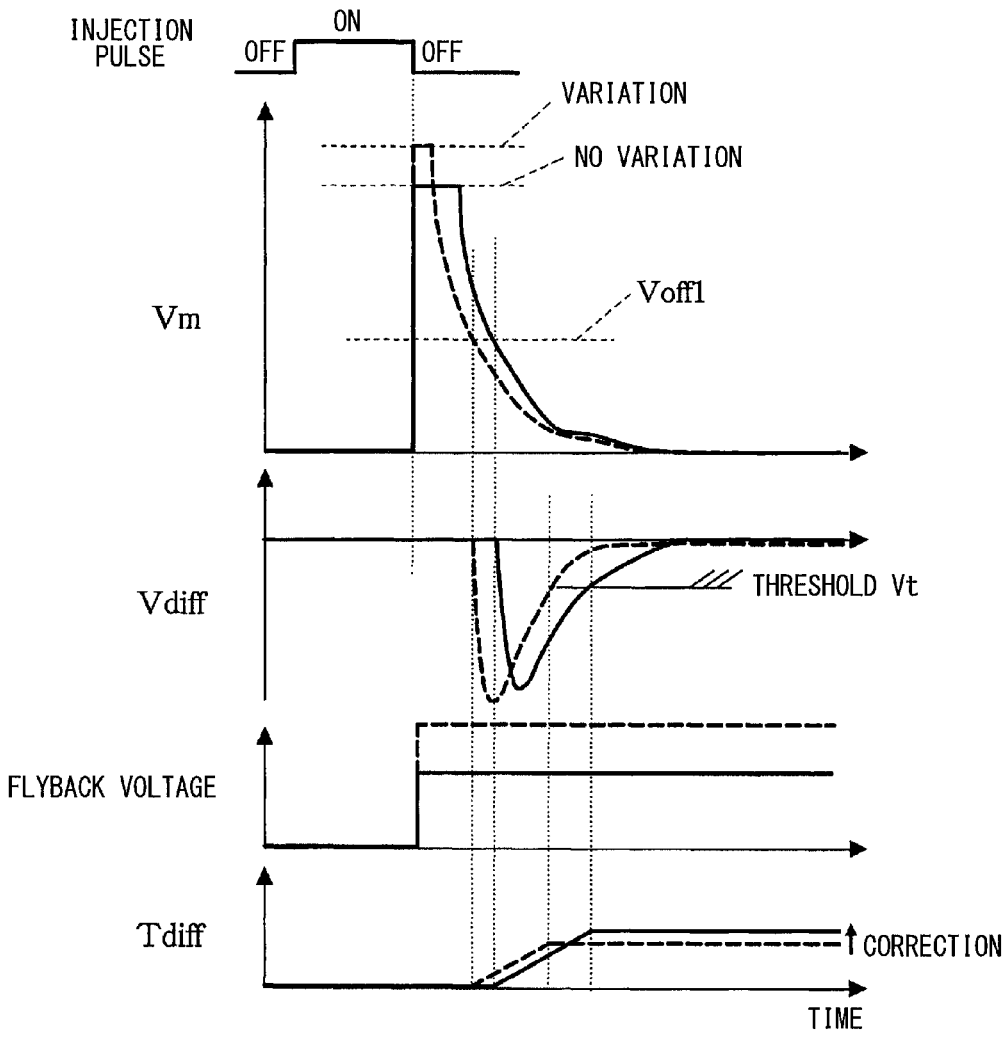
FIG. 19 is a time chart explaining a countermeasure to a maximum variation in a minus-terminal voltage.

Furthermore, as shown in FIG. 19, in order to reduce the variation in maximum value of negative terminal voltage Vm, the ECU 30 obtains the maximum value of the negative terminal voltage Vm after the injection pulse becomes off and corrects the voltage inflection point time Tdiff based on the maximum value of the negative terminal voltage Vm.

According to the above, the voltage inflection point time Tdiff can be corrected according to the variation in negative terminal voltage Vm.

Hereinafter, referring to FIG. 20, the processing of the voltage inflection point time computation routine will be explained, which the ECU 30 performs.

In step 501, the computer determines whether the partial-lift injection is being performed. When the answer is NO, the procedure ends.

Meanwhile, when the answer is YES in 501, the procedure proceeds to step 502 in which the ECU 30 obtains the negative terminal voltage Vm.

Then, the procedure proceeds to step 503 in which the voltage inflection point time Tdiff is computed. That is, the voltage inflection time Tdiff is a time period from the negative terminal voltage Vm falls below the specified value Voff1 until the difference Vdiff exceeds a threshold Vt.

Then, the procedure proceeds to step 504 in which the ECU 30 obtains the prescribed voltage time which is a time period from the injection pulse becomes on until the negative terminal voltage Vm falls below the specified value Voff2.

Then, the procedure proceeds to step 505 in which the ECU 30 obtains the maximum value of the negative terminal voltage Vm after the injection pulse is off.

Then, the procedure proceeds to step 506 in which a first correction value is computed in view of the first correction map. The first correction value corresponds to the prescribed voltage time. In the first correction map, as the prescribed voltage time is prolonged, the first correction value becomes smaller. The first correction map is previously formed based on experimental data and design data, and is stored in the ROM of the ECU 30.

Then, the procedure proceeds to step 507 in which a second correction value is computed in view of the second correction map. The second correction value corresponds to the maximum value of the negative terminal voltage Vm. In the second correction map, as the maximum value of the negative terminal voltage Vm is larger, the second correction value becomes larger. The second correction map is previously formed based on experimental data and design data, and is stored in the ROM of the ECU 30.

Then, the procedure proceeds to step 508 in which the voltage inflection time Tdiff is corrected based on the first correction value and the second correction value. (For example, the first correction value and the second correction value are added to the voltage inflection time Tdiff.)

In the fifth embodiment, in order to reduce the variation in falling timing of the negative terminal voltage Vm, the negative terminal voltage Vm is computed based the reference timing at which the negative terminal voltage Vm falls below the specified value Voff1, after the injection pulse is off. That is, the voltage inflection time Tdiff is a time period from the negative terminal voltage Vm falls below the specified value Voff1 until the difference Vdiff exceeds a threshold Vt. According to the above, even if time offset deviation of the negative terminal voltage Vm arises with the variation in the falling timing of the negative terminal voltage Vm, the voltage inflection point time Tdiff can be computed. Thereby, even if the variation in the falling timing of the negative terminal voltage Vm arises, the variation in the voltage inflection time Tdiff can be restricted or avoided (refer to FIG. 17).

Further, in order to reduce the variation in response speed of the negative terminal voltage Vm, the ECU 30 obtains the prescribed voltage time. Based on the prescribed voltage time, the voltage inflection point time Tdiff is corrected. Thus, the voltage inflection point time Tdiff can be corrected according to the response speed of the negative terminal voltage Vm. The variation in voltage inflection point time Tdiff can be accurately corrected (refer to FIG. 18).

Further, in order to reduce the variation in maximum value of the negative terminal voltage Vm, the ECU 30 obtains the maximum value of the negative terminal voltage Vm after the injection pulse becomes off and corrects the voltage inflection point time Tdiff based on the maximum value of the negative terminal voltage Vm. According to the above, the voltage inflection point time Tdiff can be corrected according to the variation in negative terminal voltage Vm. The variation in voltage inflection point time Tdiff can be accurately corrected (refer to FIG. 19).

According to the above, the voltage inflection point time Tdiff can be accurately obtained. The correction accuracy of the injection pulse can be improved.

In the fifth embodiment, the prescribed voltage time is a time period from the injection pulse becomes on until the negative terminal voltage Vm falls below the specified value Voff2. However, the prescribed voltage time may be a time period from the injection pulse becomes off until the negative terminal voltage Vm falls below the specified value Voff2.

Moreover, in the fifth embodiment, the variation in falling timing of the negative terminal voltage Vm, the variation in response speed of the negative terminal voltage Vm and the variation in maximum value of the negative terminal voltage Vm are reduced. However, at least one of the variations may be reduced.

Moreover, in the fifth embodiment, the voltage inflection time Tdiff is a time period from the negative terminal voltage Vm falls below the specified value Voff1 until the difference Vdiff exceeds a threshold Vt. That is, the voltage inflection time Tdiff is a time period from the negative terminal voltage Vm falls below the specified value Voff1 until the second order differential Vdiff2 becomes an extreme value.

Sixth Embodiment

Figure 23:
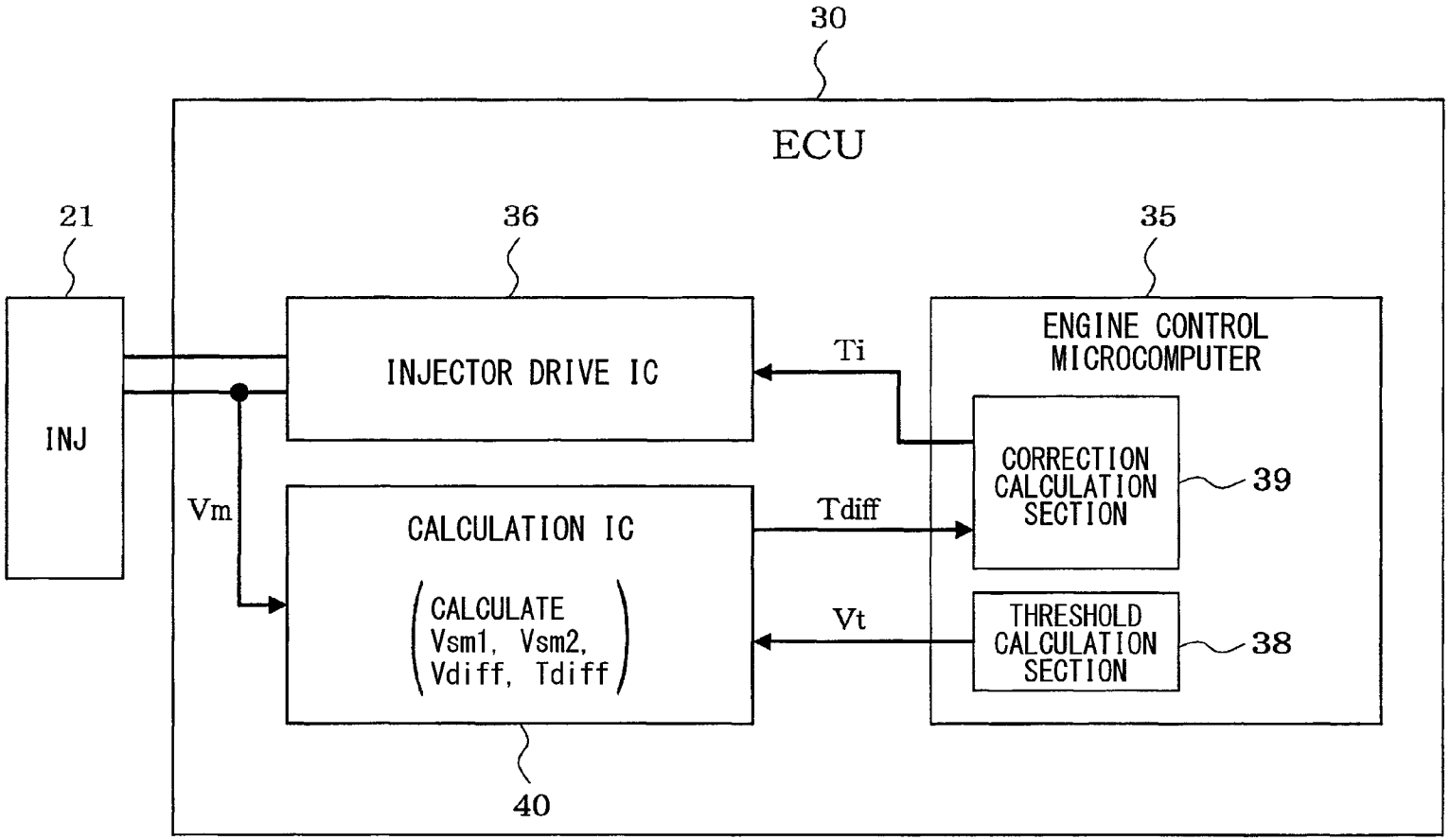
FIG. 23 is a block chart showing a configuration of an ECU in a sixth embodiment.

Referring to FIG. 23, a sixth embodiment will be described hereinafter. In the sixth embodiment, the same parts and components as those in the first embodiment are indicated with the same reference numerals and the same descriptions will not be reiterated.

As shown in FIG. 23, the ECU 30 has a calculation IC 40 besides the injector drive IC 36. The calculation IC 40 computes the first filtered voltage Vsm1 and the second filtered voltage Vsm2 while the partial-lift injection is performed. Furthermore, the calculation IC 40 computes the difference Vdiff and the voltage inflection time Tdiff.

Alternatively, the calculation IC 40 computes the third filtered voltage Vdiff.sm3 and the fourth filtered voltage Vdiff.sm4. Furthermore, the calculation IC 40 may computes the second order differential Vdiff2 and the voltage inflection time Tdiff.

Furthermore, the calculation IC 40 may correct the voltage inflection time Tdiff according to the prescribed voltage time and the maximum value of the negative terminal voltage Vm.

In this case, the calculation IC 40 corresponds to a filtered-voltage acquisition portion, a difference calculation portion and a time calculation portion.

In the sixth embodiment, since the calculation IC 40 functions as the filtered-voltage acquisition portion, the difference calculation portion and a time calculation portion, an arithmetic load of the engine control microcomputer 35 can be reduced.

Seventh Embodiment

Figure 24:
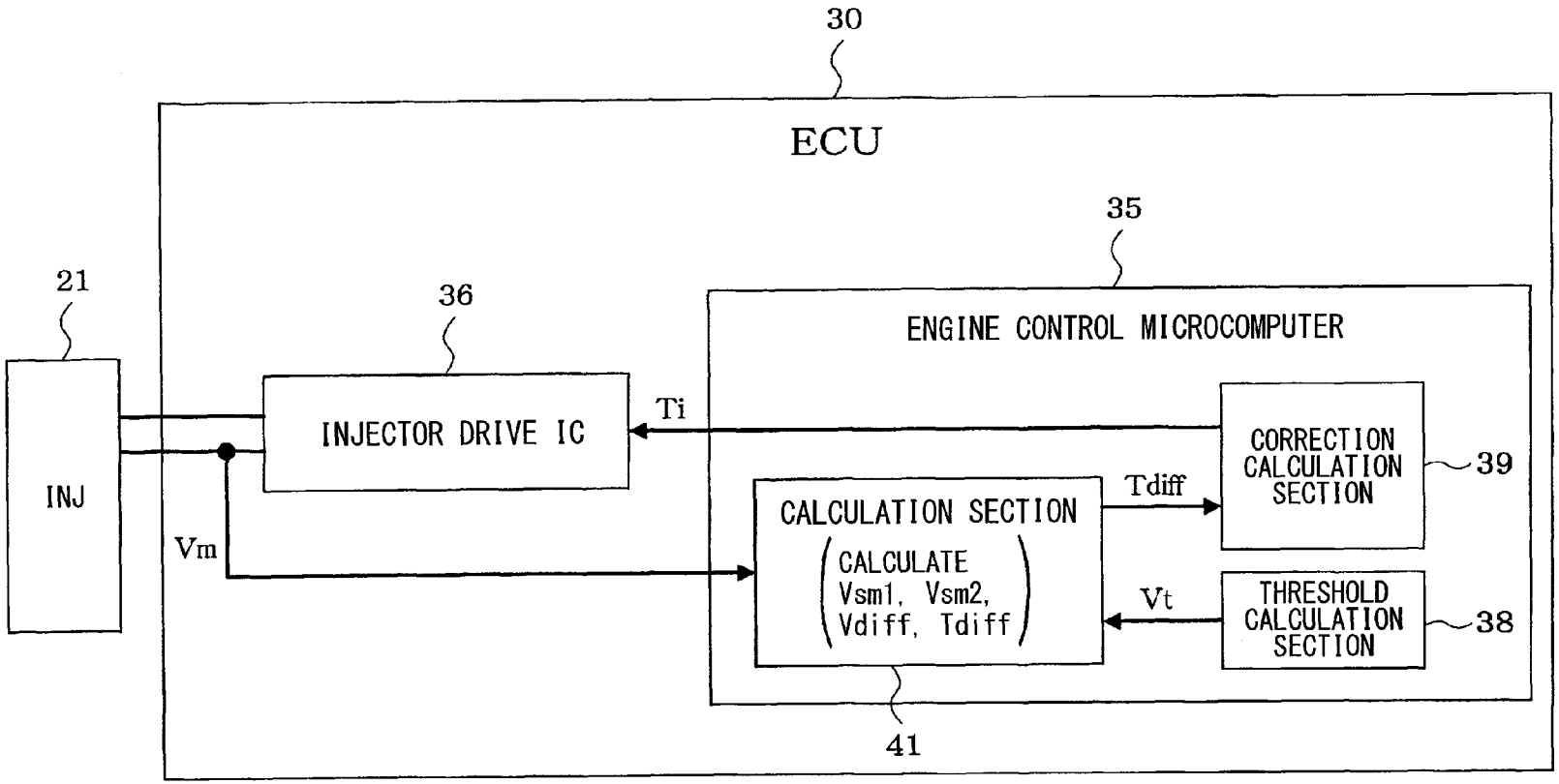
FIG. 24 is a block chart showing a configuration of an ECU in a seventh embodiment.

Referring to FIG. 24, a seventh embodiment will be described hereinafter. In the seventh embodiment, the same parts and components as those in the first embodiment are indicated with the same reference numerals and the same descriptions will not be reiterated.

As shown in FIG. 24, a calculation section 41 of the engine control microcomputer 35 computes the first filtered voltage Vsm1 and the second filtered voltage Vsm2 while the partial-lift injection is performed. Furthermore, the calculation section 41 computes the difference Vdiff and the voltage inflection time Tdiff.

Alternatively, the calculation section 41 computes the third filtered voltage Vdiff.sm3 and the fourth filtered voltage Vdiff.sm4. Furthermore, the calculation section 41 may computes the second order differential Vdiff2 and the voltage inflection time Tdiff.

Furthermore, the calculation section 41 may correct the voltage inflection time Tdiff according to the prescribed voltage time and the maximum value of the negative terminal voltage Vm.

In this case, the calculation section 41 corresponds to a filtered-voltage acquisition portion, a difference calculation portion and a time calculation portion.

In the seventh embodiment, since the engine control microcomputer 35 (calculation section 41) functions as the filtered-voltage acquisition portion, the difference calculation portion and a time calculation portion, these function can be performed by changing a specification of the engine control microcomputer 35.

In the above embodiments, the digital filters are used as the first to the fourth low-pass filter. However, the analog filter can be used as the first to the fourth low-pass filter.

Moreover, in the above embodiments, the voltage inflection time is computed based on the negative terminal voltage of the fuel injector 21. However, the voltage inflection time may be computed based on a positive terminal voltage of the fuel injector 21.

The present disclosure can be applied to a system equipped with the fuel injector for intake port injection.

This disclosure is described according to the embodiments. However, it is understood that this disclosure is not limited to the above embodiments or the structures. This disclosure includes various modified examples, and modifications falling within an equivalent range. In addition, various combinations or configurations as well as other combinations or configurations including only one element, or more than or lower than one element therein also fall within a category and a conceptual range of this disclosure.

The invention claimed is:

1. A fuel injection control system of an internal combustion engine having an electromagnetic driving fuel injection valve, the fuel injection control system comprising:

an injection control portion that performs partial lift injection to drive the fuel injection valve to open with an injection pulse allowing a lift amount of a valve element of the fuel injection valve not to reach a full lift position;

a filtered-voltage acquisition portion that, after off of an injection pulse of the partial lift injection, acquires a first filtered voltage being a terminal voltage of the fuel injection valve filtered by a first low-pass filter having a first frequency as a cutoff frequency, the first frequency being lower than a frequency of a noise component, and acquires a second filtered voltage being the terminal voltage filtered by a second low-pass filter having a second frequency as a cutoff frequency, the second frequency being lower than the first frequency;

a difference calculation portion that calculates a difference between the first filtered voltage and the second filtered voltage;

a time calculation portion that calculates time from a predetermined reference timing to a timing when the difference has an inflection point as voltage inflection time; and an injection pulse correction portion that corrects the injection pulse of the partial lift injection based on the voltage inflection time.

2. The fuel injection control system of the internal combustion engine according to claim 1, wherein the first low-pass filter and the second low-pass filter are each a digital filter.

3. The fuel injection control system of the internal combustion engine according to claim 2, wherein the first low-pass filter is a digital filter implemented by Formula (1) that uses a previous value Vsm1(k−1) of the first filtered voltage and a current value Vm(k) of the terminal voltage to obtain a current value Vsm1(k) of the first filtered voltage, a sampling frequency fs of the terminal voltage and the cutoff frequency f1 of the first low-pass filter satisfying a relationship of Formula (2), $$Vsm1(k)=\{(n1-1)/n1\}\times Vsm1(k-1)+(1/n1)\times Vm(k) \quad (1),$$

$$1/fs:1/f1=1:(n1-1) \quad (2).$$

4. The fuel injection control system of the internal combustion engine according to claim 2, wherein the second low-pass filter is a digital filter implemented by Formula (3) that uses a previous value Vsm2(k−1) of the second filtered voltage and a current value Vm(k) of the terminal voltage to obtain a current value Vsm2(k) of the second filtered voltage, a sampling frequency fs of the terminal voltage and the cutoff frequency f2 of the second low-pass filter satisfying a relationship of Formula (4), $$Vsm2(k)=\{(n2-1)/n2\}\times Vsm2(k-1)+(1/n2)\times Vm(k) \quad (3),$$

$$1/fs:1/f2=1:(n2-1) \quad (4).$$

5. The fuel injection control system of the internal combustion engine according to claim 1, wherein the time calculation portion calculates the voltage inflection time with a timing when the difference exceeds a predetermined threshold as the timing when the difference has the inflection point.

6. The fuel injection control system of the internal combustion engine according to claim 1, wherein the filtered-voltage acquisition portion acquires a third filtered voltage being the difference filtered by a third low-pass filter having a third frequency as a cutoff frequency, the third frequency being lower than a frequency of a noise component, and acquires a fourth filtered voltage being the difference filtered by a fourth low-pass filter having a fourth frequency as the cutoff frequency, the fourth frequency being lower than the third frequency, wherein the difference calculation portion calculates a difference between the third filtered voltage and the fourth filtered voltage as a second order differential, and wherein the time calculation portion calculates the voltage inflection time with a timing when the second order differential has an extreme value as the timing when the difference has the inflection point.

7. The fuel injection control system of the internal combustion engine according to claim 6, wherein when the second order differential no longer increases, the time calculation portion determines the second order differential has the extreme value.

8. The fuel injection control system of the internal combustion engine according to claim 6, wherein the third low-pass filter and the fourth low-pass filter are each a digital filter.

9. The fuel injection control system of the internal combustion engine according to claim 8, wherein the third low-pass filter is a digital filter implemented by Formula (5) that uses a previous value Vdiff.sm3(k−1) of the third filtered voltage and a current value Vdiff(k) of the difference to obtain a current value Vdiff.sm3(k) of the third filtered voltage, a sampling frequency fs of the terminal voltage and the cutoff frequency of the third low-pass filter satisfying a relationship of Formula (6), $$Vdiff.sm3(k)=\{(n3-1)/n3\}\times Vdiff.sm3(k-1)+(1/n3)\times Vdiff(k) \quad (5),$$

$$1/fs:1/f3=1:(n3-1) \quad (6).$$

10. The fuel injection control system of the internal combustion engine according to claim 8, wherein the fourth low-pass filter is a digital filter implemented by Formula (7) that uses a previous value Vdiff.sm4(k−1) of the fourth filtered voltage and a current value Vdiff(k) of the difference to obtain a current value Vdiff.sm4(k) of the fourth filtered voltage, a sampling frequency fs of the terminal voltage and the cutoff frequency f4 of the fourth low-pass filter satisfying a relationship of Formula (8), $$Vdiff.sm4(k)=\{(n4-1)/n4\}\times Vdiff.sm4(k-1)+(1/n4)\times Vdiff(k) \quad (7),$$

$$1/fs:1/f4=1:(n4-1) \quad (8).$$

11. The fuel injection control system of the internal combustion engine according to claim 1, wherein a drive IC of the fuel injection valve collectively serves as the filtered-voltage acquisition portion, the difference calculation portion, and the time calculation portion.

12. The fuel injection control system of the internal combustion engine according to claim 1, wherein a calculation IC provided separately from the drive IC of the fuel injection valve collectively serves as the filtered-voltage acquisition portion, the difference calculation portion, and the time calculation portion.

13. The fuel injection control system of the internal combustion engine according to claim 1, wherein a microcomputer controlling the internal combustion engine collectively serves as the filtered-voltage acquisition portion, the difference calculation portion, and the time calculation portion.

14. The fuel injection control system of the internal combustion engine according to claim 1, wherein the time calculation portion calculates the voltage inflection time with the reference timing being a timing when the injection pulse of the partial lift injection is switched from off to on.

15. The fuel injection control system of the internal combustion engine according to claim 1, wherein the time calculation portion calculates the voltage inflection time with the reference timing being a timing when the injection pulse of the partial lift injection is switched from on to off.

16. The fuel injection control system of the internal combustion engine according to claim 1, wherein the time calculation portion calculates the voltage inflection time with the reference timing being a timing when the terminal voltage becomes lower than a predetermined value after off of the injection pulse of the partial lift injection.

17. The fuel injection control system of the internal combustion engine according to claim 1, wherein the time calculation portion resets the voltage inflection time at the reference timing and then starts calculation of the voltage inflection time, and completes the calculation of the voltage inflection time at a timing when the difference has the inflection point, and maintains the calculated value of the voltage inflection time until the next reference timing.

18. The fuel injection control system of the internal combustion engine according to claim 1, wherein the time calculation portion acquires information of variations in the terminal voltage after off of the injection pulse of the partial lift injection, and corrects the voltage inflection time in correspondence to the information of variations in the terminal voltage.

19. The fuel injection control system of the internal combustion engine according to claim 18, wherein the time calculation portion acquires, as the information of variations in the terminal voltage, time from a timing when the injection pulse of the partial lift injection is switched into on or off to a timing when the terminal voltage becomes lower than a predetermined value after off of the injection pulse (hereinafter, simply referred to as "predetermined voltage arrival time"), and corrects the voltage inflection time in correspondence to the predetermined voltage arrival time.

20. The fuel injection control system of the internal combustion engine according to claim 18, wherein the time calculation portion acquires, as the information of variations in the terminal voltage, a maximum value of the terminal voltage after off of the injection pulse of the partial lift injection, and corrects the voltage inflection time in correspondence to the maximum value of the terminal voltage.

* * * * *